United States Patent [19]

Yu

[11] Patent Number: 4,658,248

[45] Date of Patent: Apr. 14, 1987

[54] METHOD FOR GENERATING STROKE-VECTOR CHARACTERS FOR USE IN A DISPLAY SYSTEM

[75] Inventor: Oliver T. Yu, Vancouver, Canada

[73] Assignee: Microtel Limited, Burnaby, Canada

[21] Appl. No.: 667,232

[22] Filed: Nov. 1, 1984

[51] Int. Cl.[4] ..... G09G 1/10

[52] U.S. Cl. ..... 340/739; 340/732

[58] Field of Search ..... 340/731, 732, 739, 750, 340/747, 723

[56] References Cited

U.S. PATENT DOCUMENTS

| | | | |
|---|---|---|---|
| 4,205,309 | 5/1980 | Music | 340/739 |
| 4,311,998 | 1/1982 | Matheratt et al. | 340/739 X |
| 4,321,596 | 3/1982 | Hernandez et al. | 340/724 |
| 4,321,597 | 3/1982 | Martin | 340/724 |
| 4,331,955 | 5/1982 | Hansen | 340/739 X |
| 4,455,554 | 6/1984 | Demke | 340/731 |
| 4,491,836 | 1/1985 | Collmayer et al. | 340/732 X |
| 4,507,656 | 3/1985 | Morey et al. | 340/739 |
| 4,553,214 | 11/1985 | Dettmer | 340/339 X |

OTHER PUBLICATIONS

WO82/04153-"Terminal Generation of Dynamically Redefinable Character Sets" James Richard Fleming et al.

*Primary Examiner*—Marshall M. Curtis

*Assistant Examiner*—Vincent P. Kovalick

*Attorney, Agent, or Firm*—Douglas M. Gilbert

[57] ABSTRACT

A novel method is disclosed for use in an electronic raster-scan display system, for generating characters using a stroke-vector technique. An incoming data signal defines the type of character to be displayed, the character field dimensions, the character drawing point, and any character rotation or reflection. Using that part of the data signal that defines the character type as a memory address, a character microprogram is retrieved containing a plurality of encoded binary valued stroke-drawing directives. These directives are instructions detailing how to generate all of the shape dependent attributes for a series of chain related stroke-vectors that define the overall shape of a character to be displayed. The encoded drawing directives are decoded and sequentially applied to a set of initial values that define an initial virtual stroke-vector, and thereby generating all of the character-shape dependent stroke attributes to for a series of chain related stroke-vectors that define a character shape. Once defined each stroke-vector is scaled so that the generated character cell size corresponds to the character field dimensions defined by the external data signal. Lastly a logical pel may be generated and added to the individual stroke-vectors before the connected stroke-vectors are projected onto the display screen at the character drawing point.

11 Claims, 27 Drawing Figures

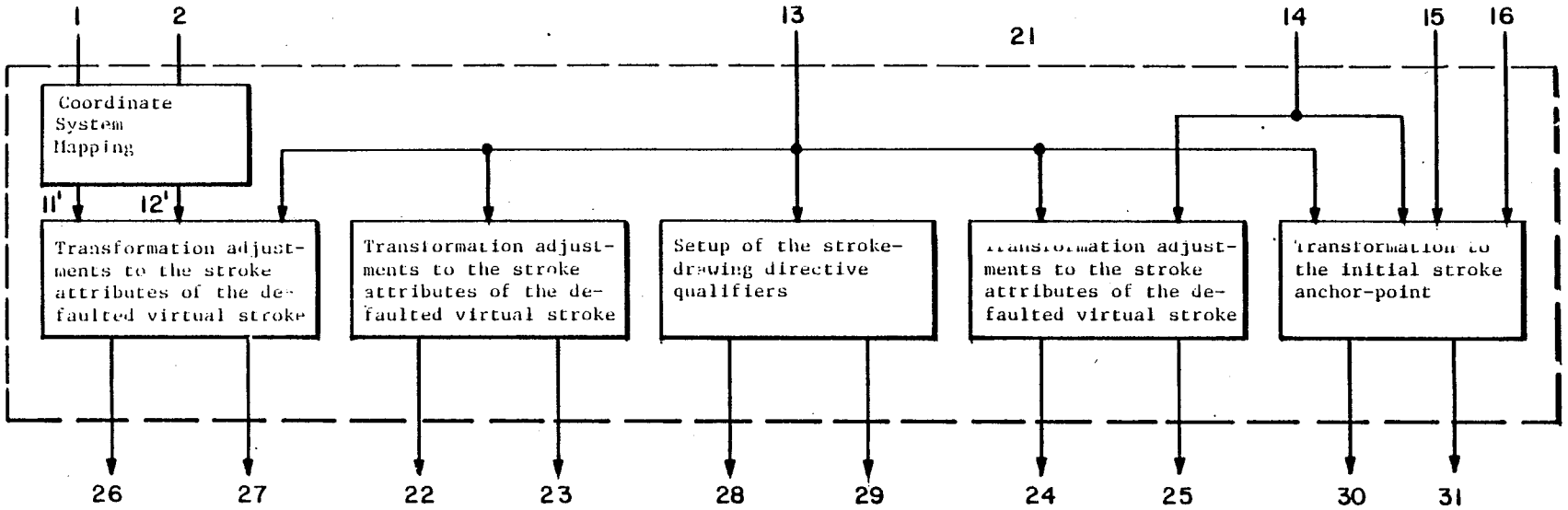

OUTPUT SIGNALS:

Signals 11-14 Designate character transformation signals:
- Signal 11 - Character field horizontal dimension
- Signal 12 - Character field vertical dimension
- Signal 13 - Character rotation
- Signal 14 - Character reflection Signals 15-16 Designate the X and Y-components of the character drawing point

OUTPUT SIGNALS:

Signals 22-27 Designate the stroke attributes of the defaulted virtual stroke:
- Signal 22 - DX-EXIST-STATUS
- Signal 23 - DY-EXIST-STATUS
- Signal 24 - DX-SIGN
- Signal 25 - DY-SIGN
- Signal 26 - DX-LENGTH
- Signal 27 - DY-LENGTH Signals 30-31 Designate the X and Y-components of the initial stroke anchor point Signals 28-29 Designate the directive qualifiers:
- Signal 30 - DX-SIGN-QUALIFIER
- Signal 31 - DY-SIGN-QUALIFIER

FIG. 3

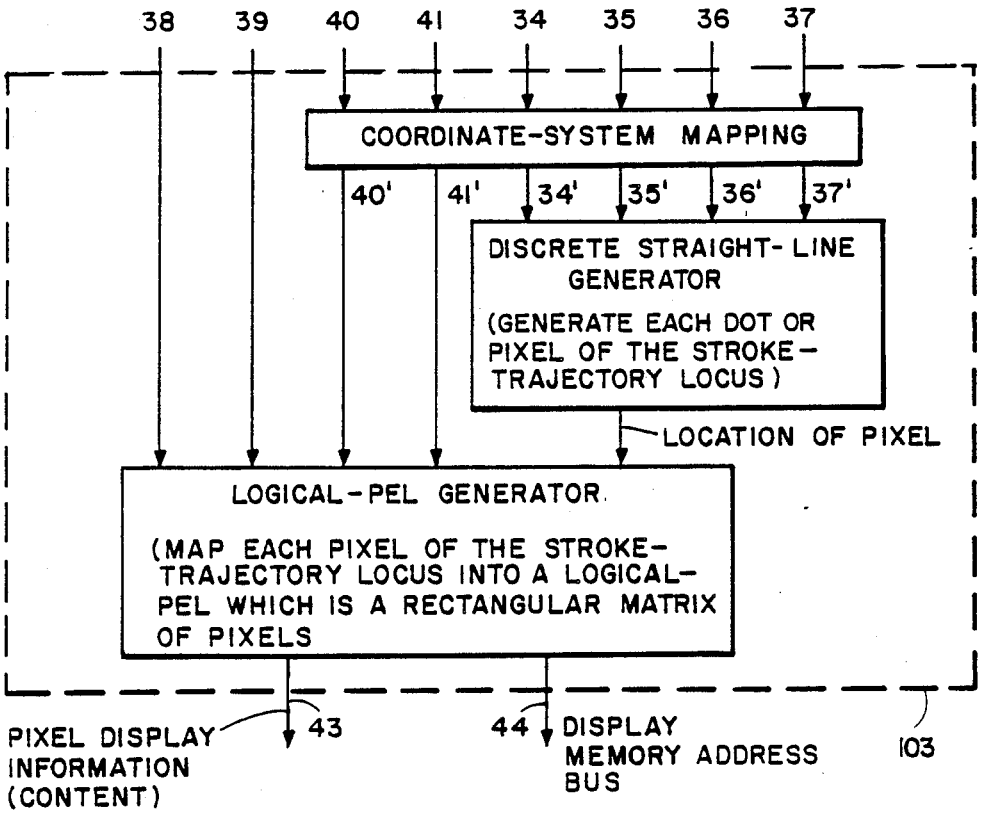

INPUT SIGNALS:

SIGNALS 34, 35 DESIGNATE THE X AND Y COMPONENTS OF THE STROKE-TRAJECTORY ANCHOR POINT. SIGNALS 36, 37 DESIGNATE THE X AND Y COMPONENTS OF THE STROKE TRAJECTORY TAIL POINT.

SIGNALS 40, 41 DESIGNATE THE LENGTHS OF THE LOGICAL-PEL'S HORIZONTAL AND VERTICAL DISPLACEMENTS FROM THE STROKE-TRAJECTORY LOCUS (PEL X-LENGTH & PEL Y-LENGTH).

SIGNALS 38, 39 DESIGNATE THE SIGN OF THE LOGICAL PEL'S HORIZONTAL AND VERTICAL DISPLACEMENTS FROM THE STROKE-TRAJECTORY LOCUS.

OUTPUT SIGNAL:

SIGNAL 43 DESIGNATES THE DISPLAY INTENSITY INFORMATION OF A GENERATED PIXEL. SIGNAL 44 DESIGNATES THE DISPLAY MEMORY ADDRESS OF A GENERATED PIXEL.

FIG. 7

PHYSICAL-PIXEL SCREEN
(physical-display screen)

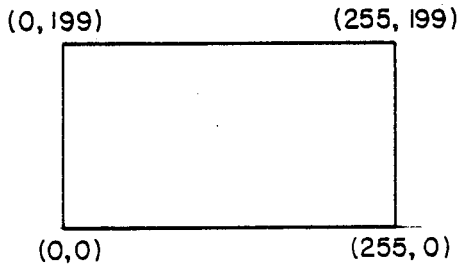

Horizontal physical-pixel resolution = 256
Vertical physical-pixel resolution = 200

Coordinate value is represented by
8-bit unsigned binary number

VIRTUAL-PIXEL SCREEN

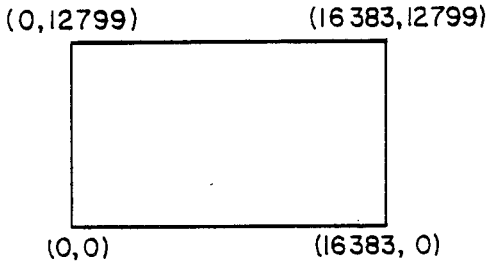

Horizontal virtual-pixel resolution = 16384
Vertical virtual-pixel resolution = 12800

Coordinate value is represented by
14-bit unsigned binary number

COORDINATE-SYSTEM MAPPING BETWEEN VIRTUAL-PIXEL SCREEN COORDINATE SYSTEM AND THE PHYSICAL-PIXEL SCREEN COORDINATE SYSTEM:

- A PHYSICAL OR VIRTUAL PIXEL IS IDENTIFIED BY AN INTEGER COORDINATE PAIR (IX,IY), WHERE ($0 \leq IX <$ HORIZONTAL PIXEL RESOLUTION) AND ($0 \leq IY <$ VERTICAL PIXEL RESOLUTION); AN INTEGER COORDINATE PAIR (IX,IY) WILL DESIGNATE A XY-REGION IN THE PIXEL SCREEN COORDINATE SYSTEM WHERE ($IX \leq X < IX+1$) AND ($IY \leq Y < IY+1$)

- HORIZONTAL RESOLUTION RATIO = $\frac{\text{HORIZONTAL VIRTUAL-PIXEL SCREEN RESOLUTION}}{\text{HORIZONTAL PHYSICAL-PIXEL SCREEN RESOLUTION}} = \frac{16384}{256}$
  = 64

VERTICAL RESOLUTION RATIO = $\frac{\text{VERTICAL VIRTUAL-PIXEL SCREEN RESOLUTION}}{\text{VERTICAL PHYSICAL-PIXEL SCREEN RESOLUTION}} = \frac{12800}{200}$
  = 64

- A COORDINATE PAIR (VX,VY) IN THE VIRTUAL-PIXEL SCREEN COORDINATE SYSTEM WILL MAP INTO A COORDINATE PAIR (PX,PY) IN THE PHYSICAL-PIXEL SCREEN COORDINATE SYSTEM; WHERE PX = VX/HORIZONTAL RESOLUTION RATIO AND PY = VY/VERTICAL RESOLUTION RATIO, OR VX = PX (HORIZONTAL RESOLUTION RATIO) AND VY = PY (VERTICAL RESOLUTION RATIO)

FIG. 8

PEL X = LENGTH, PEL Y - LENGTH : LENGTHS OF LOGICAL-PEL'S HORIZONTAL AND VERTICAL DISPLACEMENTS FROM THE STROKE-TRAJECTORY LOCUS $\theta$ : STROKE-TRAJECTORY'S INCLINATION WITH RESPECT TO THE HORIZONTAL STROKE WIDTH = PEL X-LENGTH arc sin $\theta$ + PEL Y-LENGTH arc cos $\theta$

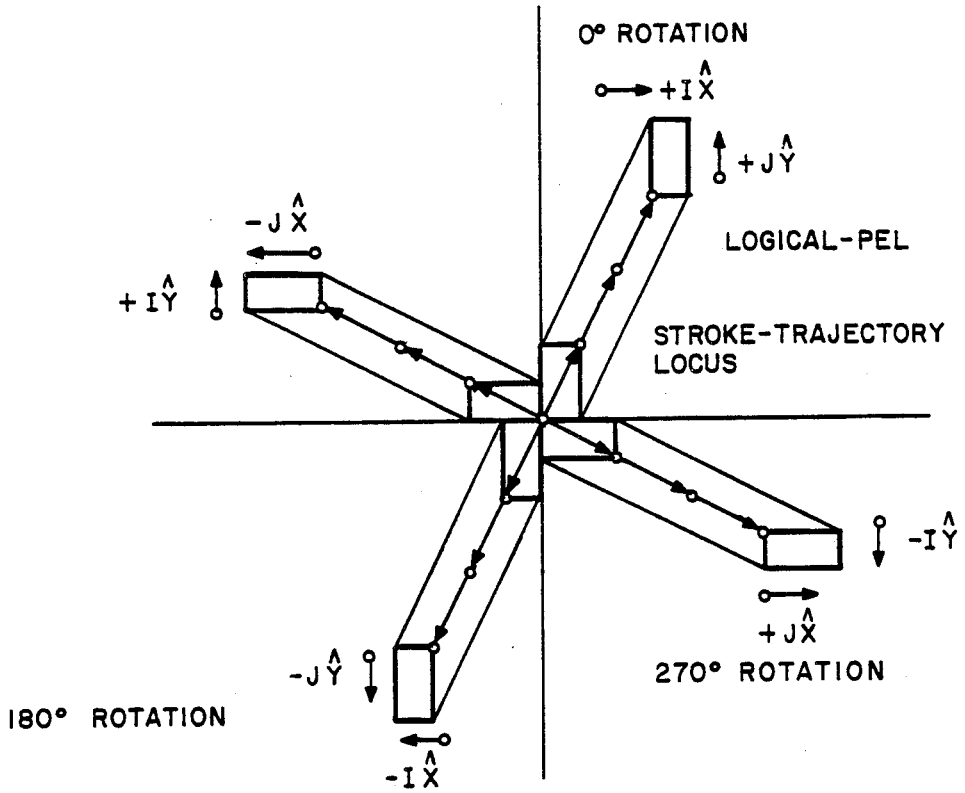

$\hat{X}$ AND $\hat{Y}$ : LOGICAL-PEL'S HORIZONTAL AND VERTICAL DISPLACEMENTS FROM THE STROKE LOCUS I AND J : LENGTH OF LOGICAL-PEL'S DISPLACEMENTS
WHERE, I = CHARACTER FIELD HORIZONTAL DIMENSION/ HORIZONTAL STROKE RESOLUTION
J = CHARACTER FIELD VERTICAL DIMENSION/ VERTICAL STROKE RESOLUTION

| CHARACTER ROTATION | LOGICAL-PEL'S HORIZONTAL DISPLACEMENT | LOGICAL-PEL VERTICAL DISPLACEMENT | GEOMETRIC ALIGNMENT OF STROKE LOCUS POINT WITHIN THE LOGICAL-PEL |
|---|---|---|---|
| 0° | +I | +J | LOWER LEFT CORNER |
| 90° | -J | +I | LOWER RIGHT CORNER |
| 180° | -I | -J | UPPER RIGHT CORNER |
| 270° | +J | -I | UPPER LEFT CORNER |

FIG. 13

STROKE DECODER'S OPERATION PHASES IN DECODING THE CHARACTER "P"

| CODE STEP (1) | CODE DIRECTIVE (2) | DX-EXIST STATUS (3) | DY-EXIST STATUS (4) | DX-SIGN (5) | DY-SIGN (6) | VISIBILITY STATUS (7) |
|---|---|---|---|---|---|---|
| 0 | | true | true | + | + | visible |
| 1 | 00 11 | true | true | + | + | invisible |
| 2 | 01 | false | true | + | + | invisible |
| 3 | 11 | false | true | + | + | invisible |
| 4 | 00 11 | false | true | + | + | visible |
| 5 | 11 | false | true | + | + | visible |
| 6 | 11 | false | true | + | + | visible |
| 7 | 11 | false | true | + | + | visible |
| 8 | 11 | false | true | + | + | visible |
| 9 | 11 | false | true | + | + | visible |
| 10 | 11 | false | true | + | + | visible |
| 11 | 00 00 | true | false | + | + | visible |
| 12 | 11 | true | false | + | + | visible |
| 13 | 11 | true | false | + | + | visible |
| 14 | 00 10 | true | false | + | - | visible |
| 15 | 10 | true | true | + | - | visible |
| 16 | 01 | false | true | + | - | visible |
| 17 | 00 01 | false | true | - | - | visible |
| 18 | 01 | true | true | - | - | visible |
| 19 | 10 | true | false | - | - | visible |
| 20 | 11 | true | false | - | - | visible |
| 21 | 11 | true | false | - | - | visible |

FIG. 14

STROKE DECODER'S OPERATION IN DECODING THE CHARACTER "P" ROTATED 90°

| CODE STEP (1) | CODE DIRECTIVE (2) | DX-EXIST STATUS (3) | DY-EXIST STATUS (4) | DX-SIGN (5) | DY-SIGN (6) | VISIBILITY STATUS (7) |
|---|---|---|---|---|---|---|
| 0 | | false | false | - | + | visible |
| 1 | 00 11 | false | false | - | + | invisible |
| 2 | 01 | true | false | - | + | invisible |
| 3 | 11 | true | false | - | + | invisible |
| 4 | 00 11 | true | false | - | + | visible |
| 5 | 11 | true | false | - | + | visible |
| 6 | 11 | true | false | - | + | visible |
| 7 | 11 | true | false | - | + | visible |
| 8 | 11 | true | false | - | + | visible |
| 9 | 11 | true | false | - | + | visible |
| 10 | 11 | true | false | - | + | visible |
| 11 | 00 00 | false | true | - | + | visible |
| 12 | 11 | false | true | - | + | visible |
| 13 | 11 | false | true | - | + | visible |
| 14 | 00 10 | false | true | + | + | visible |
| 15 | 10 | false | false | + | + | visible |
| 16 | 01 | true | false | + | + | visible |
| 17 | 00 01 | true | false | + | - | visible |
| 18 | 01 | false | false | + | - | visible |
| 19 | 10 | false | true | + | - | visible |
| 20 | 11 | false | true | + | - | visible |
| 21 | 11 | false | true | + | - | visible |

FIG. 15

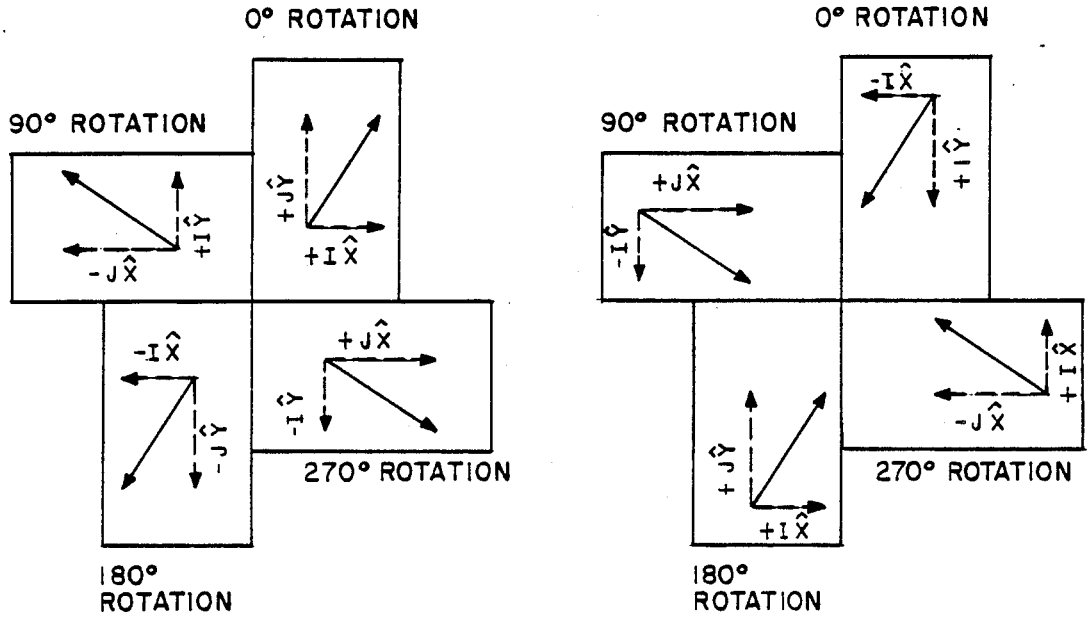

$\hat{X}$ AND $\hat{Y}$ : HORIZONTAL AND VERTICAL COMPONENT VECTORS

I AND J : LENGTHS OF COMPONENT VECTORS

WHERE, I = CHAR. FIELD VERTICAL DIMENSION / HORIZONTAL STROKE RESOLUTION

J = CHAR. FIELD VERTICAL DIMENSION / VERTICAL STROKE RESOLUTION

FOR EXAMPLE, $+I\hat{X}$ MEANS HORIZONTAL COMPONENT VECTOR IN THE POSITIVE DIRECTION WITH LENGTH I $-J\hat{Y}$ MEANS VERTICAL COMPONENT VECTOR IN THE NEGATIVE DIRECTION WITH LENGTH J

| 0° ROTATION | 90° ROTATION | 180° ROTATION | 270° ROTATION |
|---|---|---|---|
| $+I\hat{X}$ | $+I\hat{Y}$ | $-I\hat{X}$ | $-I\hat{Y}$ |
| $+J\hat{Y}$ | $-J\hat{X}$ | $-J\hat{Y}$ | $+J\hat{X}$ |
| $-I\hat{X}$ | $-I\hat{Y}$ | $+I\hat{X}$ | $+I\hat{Y}$ |
| $-J\hat{Y}$ | $+J\hat{X}$ | $+J\hat{Y}$ | $-J\hat{X}$ |

FIG. 18

TRANSFORMATION ADJUSTMENTS ATTRIBUTES OF THE DEFAULTED VIRTUAL STROKE

NO CHARACTER REFLECTION

| Stroke Attributes of Defaulted Virtual Stroke | Counterclockwise Character Rotation 0° | 90° | 180° | 270° |
|---|---|---|---|---|
| DX-EXIST-STATUS | true | false | true | false |
| DY-EXIST-STATUS | true | false | true | false |
| DX-SIGN | + | - | - | + |
| DY-SIGN | + | + | - | - |
| DX-LENGTH | i | j | i | j |
| DY-LENGTH | j | i | j | i |
| PEL-X-SIGN | + | - | - | + |
| PEL-Y-SIGN | + | + | - | - |
| PEL-X-LENGTH | i | j | i | j |
| PEL-Y-LENGTH | j | i | j | i |

Reflection About the Vertical Central Axis Within the Character Field

| Stroke Attributes of Defaulted Virtual Stroke | Counterclockwise Character Rotation 0° | 90° | 180° | 270° |
|---|---|---|---|---|
| DX-EXIST-STATUS | true | false | true | false |
| DY-EXIST-STATUS | true | false | true | false |
| DX-SIGN | - | - | + | + |
| DY-SIGN | + | - | - | + |
| DX-LENGTH | i | j | i | j |
| DY-LENGTH | j | i | j | i |
| PEL-X-SIGN | + | - | - | + |
| PEL-Y-SIGN | + | + | - | - |
| PEL-X-LENGTH | i | j | i | j |
| PEL-Y-LENGTH | j | i | j | i |

Reflection About the Horizontal Central Axis Within the Character Field

| Stroke Attributes of Defaulted Virtual Stroke | Counterclockwise Character Rotation 0° | 90° | 180° | 270° |
|---|---|---|---|---|
| DX-EXIST-STATUS | true | false | true | false |
| DY-EXIST-STATUS | true | false | true | false |
| DX-SIGN | + | + | - | - |
| DY-SIGN | - | + | + | - |
| DX-LENGTH | i | j | i | j |
| DY-LENGTH | j | i | j | i |
| PEL-X-SIGN | + | - | - | + |
| PEL-Y-SIGN | + | + | - | - |
| PEL-X-LENGTH | i | j | i | j |
| PEL-Y-LENGTH | j | i | j | i |

Notes: i = Character Field Horizontal Dimension / Horizontal Stroke Resolution
j = Character Field Vertical Dimension / Vertical Stroke Resolution

FIG. 21

TRANSFORMATION OF THE INITIAL STROKE ANCHOR POINT

Reflection About the Vertical Central Axis Within the Character Field

| Counter Clockwise Character Rotation | Corresponding Translation Transformation to Initial Stroke Anchor Point | |
|---|---|---|
| 0° | $x' = x + i$ | $y' = y$ |
| 90° | $x' = x$ | $y' = y + i$ |
| 180° | $x' = x - i$ | $y' = y$ |
| 270° | $x' = x$ | $y' = y - i$ |

Reflection About the Horizontal Central Axis Within the Character Field

| Counter Clockwise Character Rotation | Corresponding Translation Transformation to Initial Stroke Anchor Point | |
|---|---|---|
| 0° | $x' = x$ | $y' = y + j$ |
| 90° | $x' = x - j$ | $y' = y$ |
| 180° | $x' = x$ | $y' = y - j$ |
| 270° | $x' = x + j$ | $y' = y$ |

Note: $i$ = character field horizontal dimension
$j$ = character field vertical dimension
$(x, y)$ is the non-transformed initial stroke anchor point which is defined by the character drawing point.
$(x', y')$ is the transformed initial stroke anchor point.

FIG. 22

| Stroke-Drawing Directive Qualifiers | Counterclockwise Character Rotation 0° | 90° | 180° | 270° |
|---|---|---|---|---|
| DX-SIGN-QUALIFIER | 00 01 | 00 10 | 00 01 | 00 10 |
| DY-SIGN-QUALIFIER | 00 10 | 00 01 | 00 10 | 00 01 |

FIG. 23

| DX-SIGN-QUALIFIER = 00 01 : | DY-SIGN-QUALIFIER = 00 10 |
|---|---|
| Code Words : | Relative Stroke-Drawing Directives |
| 00 01 : | Switch the binary attributive value of DX-SIGN. |
| 00 10 : | Switch the binary attributive value of DY-SIGN. |

FIG. 24a

| DX-SIGN-QUALIFIER = 00 10 : | DY-SIGN-QUALIFIER = 00 01 |
|---|---|
| Code Words : | Relative Stroke-Drawing Directives |
| 00 01 : | Switch the binary attributive value of DY-SIGN. |
| 00 10 : | Switch the binary attributive value of DX-SIGN. |

FIG. 24b

METHOD FOR GENERATING STROKE-VECTOR CHARACTERS FOR USE IN A DISPLAY SYSTEM

RELATED APPLICATIONS

This application is related to application Ser. No. 667,231, filed Nov. 1, 1984, entitled "A STROKE VECTOR CHARACTER GENERATOR" and also to application Ser. No. 667,320, filed Nov. 1, 1984, entitled "A TECHNIQUE FOR SCALING CHARACTERS IN A STROKE-VECTOR DISPLAY SYSTEM."

The present invention relates generally to video display systems, and more particularly to a technique for forming characters in a raster scan dot-matrix type display system.

BACKGROUND OF THE INVENTION

Video display systems often use character generators to generate the internal signal patterns needed for displaying letters, symbols, numbers, or other characters on a display monitor. This is because a character generator permits data to be efficiently transferred within a display system or from an external source to a display system. Basically a character generator stores the image or "character mask" of all the characters to be displayed by a system.

There are two types of character generators: the dot-matrix generator and the vector or line-drawing generator. The dot-matrix character generator represents each character by a dotted-pattern character mask. Each character mask is defined by a predetermined number of dots arranged in a predetermined number of rows and columns, such as for example, a $5\times7$ or a $7\times9$ dot-matrix. Sets of characters are defined based on the same dot-matrices.

To display a character on the screen the character generator provides the relevant character mask from its internal memory to a display frame buffer. Under suitable controls, the display frame buffer maps the character dot-matrix into a matrix or raster of pixels on the display screen. A display controller scans the frame buffer contents then plots point-by-point the intensity value of each pixel on the display screen.

While widely used, there are a number of disadvantages with conventional dot-plotting character generators in a raster-scan type display system. A dot-plotting display system is several orders of magnitude slower than, for example, a vector-drawing display system. Character scaling is limited to discrete multiples of the basic character sets used, and therefore, continuous character scaling is not possible. Furthermore, when a dot-matrix character is scaled up in size, discrete quantization effects can give the magnified character an aesthetically distasteful appearance. And when scaled down in size the character becomes unreadable very quickly. Character transformations such as rotations or reflections, generally are not implemented with digital circuitry because even a simple transformation would require extensive manipulation of the stored data. Even if the economics of the situation would permit it, the CPU computation time would be unacceptably long. Analog circuits have been used; however, this technique requires digital-to-analog converters. (See *Principles Of Interactive Computer Graphics*, by Newman and Sproull, 1973 by McGraw-Hill, Inc.).

In a conventional random-scan vector-drawing display system, a character image is represented or encoded by stroke-drawing directives. A display controller decodes the stroke-drawing directives and converts them into deflection voltages to be applied to the yoke of a CRT. The starting point of a character is defined by the current beam position. Printed displays are operated in much the same way with pen motion being controlled by deflection voltages.

Manufacturers of random-scan display systems using conventional stroke-vector character generators (i.e. vector-drawing generators) generally have neglected to explore the potential of manipulating a character image by adjusting the attributes of the stroke-vectors. (An attribute is a settable parameter such as for example the horizontal stroke dimension.) For example, a character rotation transformation of a character image can be effected by applying the corresponding transformation to the composing stroke-vectors, i.e., the stroke-vectors making up the character. Another example would be the addition of an extra "width" characteristic to a stroke-vector could give the corresponding character image a more aesthetically pleasing appearance.

While the above discussion points out a number of disadvantages in employing the conventional dot-matrix character generator in raster-scan display systems and a number of potential advantages to the existing stroke-vector character generation technique; very little has been done, heretofore, to increase the effectiveness of the stroke-vector character generator in a raster-scan display system.

In the discussion of this invention, the following terminology will be used. The input signals to the character generator designate a character identification (ID) code, a character drawing point, a character rotation, a character reflection and the dimensions of the character field. A character field is defined to be a rectangular display area within which the image of a character can be defined. A character scaling transformation scales the size of a character image by scaling the character field dimensions. A character rotation transformation causes the character field to rotate counterclockwise about the character field origin. A character reflection transformation causes a reflected image of the character field about either the vertical or the horizontal center axes of the character field.

In a stroke-vector character generation system, a character image is formed on a display screen by a series of straight line trajectories of stroke-vectors (called stroke-trajectories). Each so-called stroke-trajectory is composed of one or more uniform length strokes pointing in the same direction. A single stroke or stroke-vector is defined to be a two-dimensional vector quantity having a length dimension, a width dimension, and a direction. The dimensional qualitities of a stroke-vector may be characterized by a set of stroke attributes which can either be character-field-size dependent (referred to herein as global attributes) or character-shape dependent (referred to herein as nonglobal attributes). Global attributes are directly proportional to the in-use character field dimensions. The nonglobal attributes are those parameters that affect the overall shape of a character. While the shape of a character image determines the configuration of the stroke-trajectories, the size of the character field determines the size of the stroke-trajectories.

The character drawing point (see FIG. 19) defines the physical-pixel location on the display screen to generate a character. The character drawing point is specified by an (x,y) coordinate pair that defines the character field origin.

A stroke-vector and a stroke-trajectory are both defined by the (x,y) coordinates of the two end points of the line, and these two points are referred to herein as the starting point ($x_1$,$y_1$) and the tail point ($x_2$,$y_2$). The anchor point of a stroke is provided by the tail point of the immediate preceding stroke. The initial anchor point, which is the anchor point of the very first stroke or the initial stroke, is specified by the character drawing point.

The term "stroke-trajectory transition" (or simply "stroke transition") is used herein as an aid in defining when stroke-trajectories are drawn on the display screen. As the name implies, a stroke-transition occurs when there is a change in direction of a stroke-trajectory or a change in the visibility attribute from one stroke-vector to another. More precisely when any of the nonglobal stroke attributes change from one stroke-vector to the next, a stroke-transition occurs. In FIG. 10, a stroke-transition is noted with a small "o".

The line width of a character is determined by the logical-pel. An analogy is often made to a paint brush. A brush stroke painted over a straight line trajectory is modelled in the raster-scan display by the continuous mapping of each stroke-locus of pixels to a rectangular matrix of pixels. The rectangular matrix of pixels is commonly designated as the logical-pel. Referring to FIG. 11, the width of a stroke is defined in terms of the logical-pel's horizontal and vertical displacements from the stroke's locus, and the stroke's inclination with respect to the horizontal. Referring to FIG. 13, the diagram illustrates the four possible geometric alignments of the logical-pels with respect to the stroke-trajectory locus.

OBJECTS AND SUMMARY OF THE INVENTION

In view of the foregoing, a principal object of the present invention is a novel method using stroke-vectors for generating characters in a raster-scan type display system.

Another object of the present invention is to provide an efficient storage technique for storing a minimum amount of information to provide a set of character masks for use in a display system.

A further object of the present invention is to provide a technique for generating character masks in such a manner that character transformations are very efficiently performed.

A further object of the present invention is to provide a character generation technique capable of operating with flexibility in an interactive videotex display system.

These and other objects and advantages are achieved with the present stroke-vector character generation technique. An incoming data signal defines the type of character to be displayed, the character field dimensions, the character drawing point, and any character rotation or reflection. Using that part of the data signal that defines the character type as a memory address, a character microprogram is retrieved containing a plurality of encoded binary valued stroke-drawing directives. These directives are instructions detailing how to generate all of the shape dependent attributes for a series of chain related stroke-vectors that define the overall shape of a character to be displayed. The encoded drawing directives are decoded and sequentially applied to a set of initial values that define an initial virtual stroke-vector, and thereby generating all of the character-shape dependent stroke attributes for a series of chain related stroke-vectors that define a character shape. Once defined each stroke-vector is scaled so that the generated character cell size corresponds to the character field dimensions defined by the external data signal. Each scaled stroke-vector is converted into a series of signals designating the start/stop position of each interconnected stroke-vector, and thereby defining a character mask for the character type defined by said first data signal. Lastly a logical pel may be generated and added to the individual stroke-vectors before the connected stroke-vectors are projected onto the display screen at the character drawing point.

BRIEF DESCRIPTION OF THE DRAWINGS

The above and other objects, features and advantages of the present invention will become apparent from the following detailed description of the accompanying drawings in which:

FIG. 3 is a simplified block diagram illustrating the functional operation of the transformation controller.

FIG. 7 is a simplified block diagram illustrating the functional operation of the stroke-trajectory generator.

FIG. 8 illustrates the coordinate-system mapping between the virtual-pixel screen coordinate system and the physical-pixel screen coordinate system.

FIG. 13 illustrates, for a given rotation angle, the required transformation adjustments of the lengths and signs of the logical-pel displacements from the stroke locus.

FIG. 14 illustrates the operation of the stroke decoder in decoding the relative stroke drawing directives of the character "P" when there is no character rotation and no character reflection.

FIG. 15 illustrates the stroke decoder operation in decoding the image of the character "P" with a character rotation of 90° and no character reflection.

FIG. 18 illustrates, for a given rotation angle, the required transformation adjustments of the following stroke attributes: lengths and signs of the stroke component vectors.

FIG. 21 is three tables which illustrate, for a given set of transformation signals, the corresponding set of transformation adjustments of the ten transformable stroke attributes of the defaulted virtual stroke.

FIG. 22 illustrates, for a given set of character transformation signals, the corresponding transformation of the initial stroke anchor point.

FIG. 23 is a table illustrating the required settings of the two 4-bit directive qualifiers for a given character rotation signal.

FIGS. 24*a* and 24*b* are two tables listing the two directive qualifiers (DX-SIGN-QUALIFIER and DY-SIGN-QUALIFIER) which control the decoding of the two 4-bit stroke-drawing directive code words (0001 and 0010).

DESCRIPTION OF PREFERRED EMBODIMENT

Figure 1:
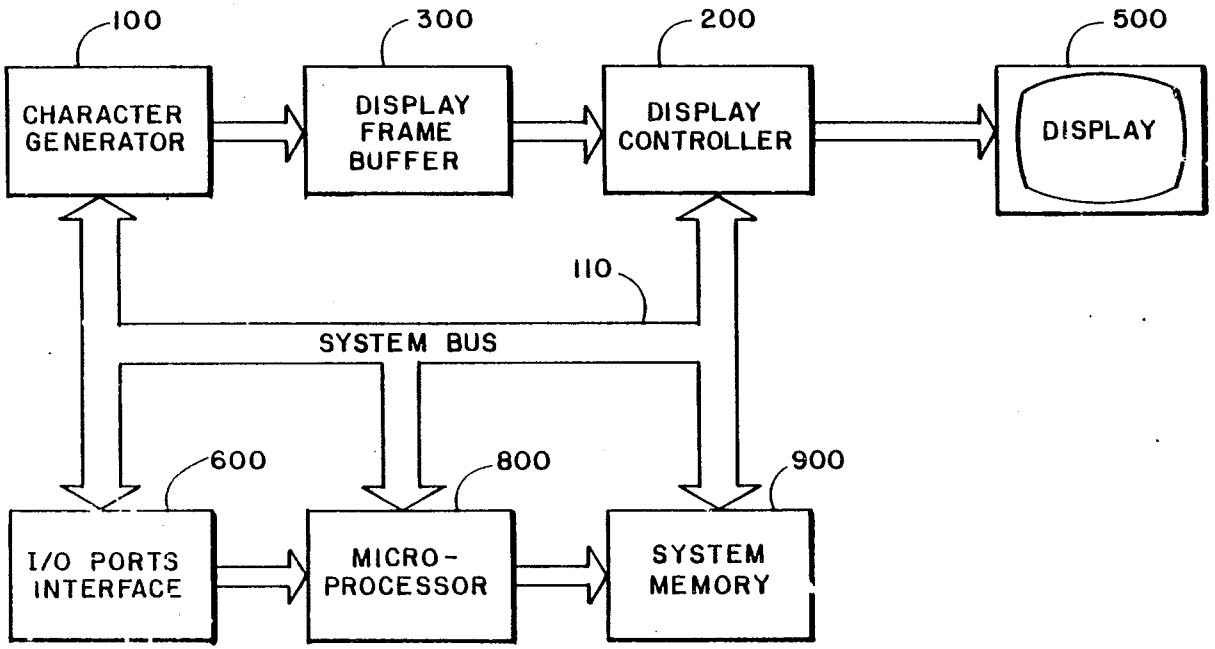
FIG. 1 is a simplified block diagram of a conventional raster-scan video display system.

Referring to FIG. 1, there is shown a very general block diagram of a conventional video display system in which a character generator 100 could be used. Character generator 100 in response to appropriate commands, generates individual character masks to be displayed on the cathode-ray screen 500. Controlling the operation of the character generator 100 and the other operations of the display system is a microprocessor 800. In practice the microprocessor 800 may be any currently available 8 or 16-bit microprocessor units. All of the functions and interactions involving the microprocessor 800 are achieved through suitable programs stored in a system memory 900 (e.g. a random access memory). Such programs are communicated to the microprocessor 800 via a bidirectional system bus 110, and are called into operation via the input/output interface 600 (e.g. a keyboard) or via various interrupt signal generated by various components of the system. The display frame buffer (memory) 300 serves to hold the display information for successive scans of the video screen. (This is sometimes referred to as a refresh buffer.) The display controller 200 generates the display deflection voltages for controlling the character display images.

Figure 2:
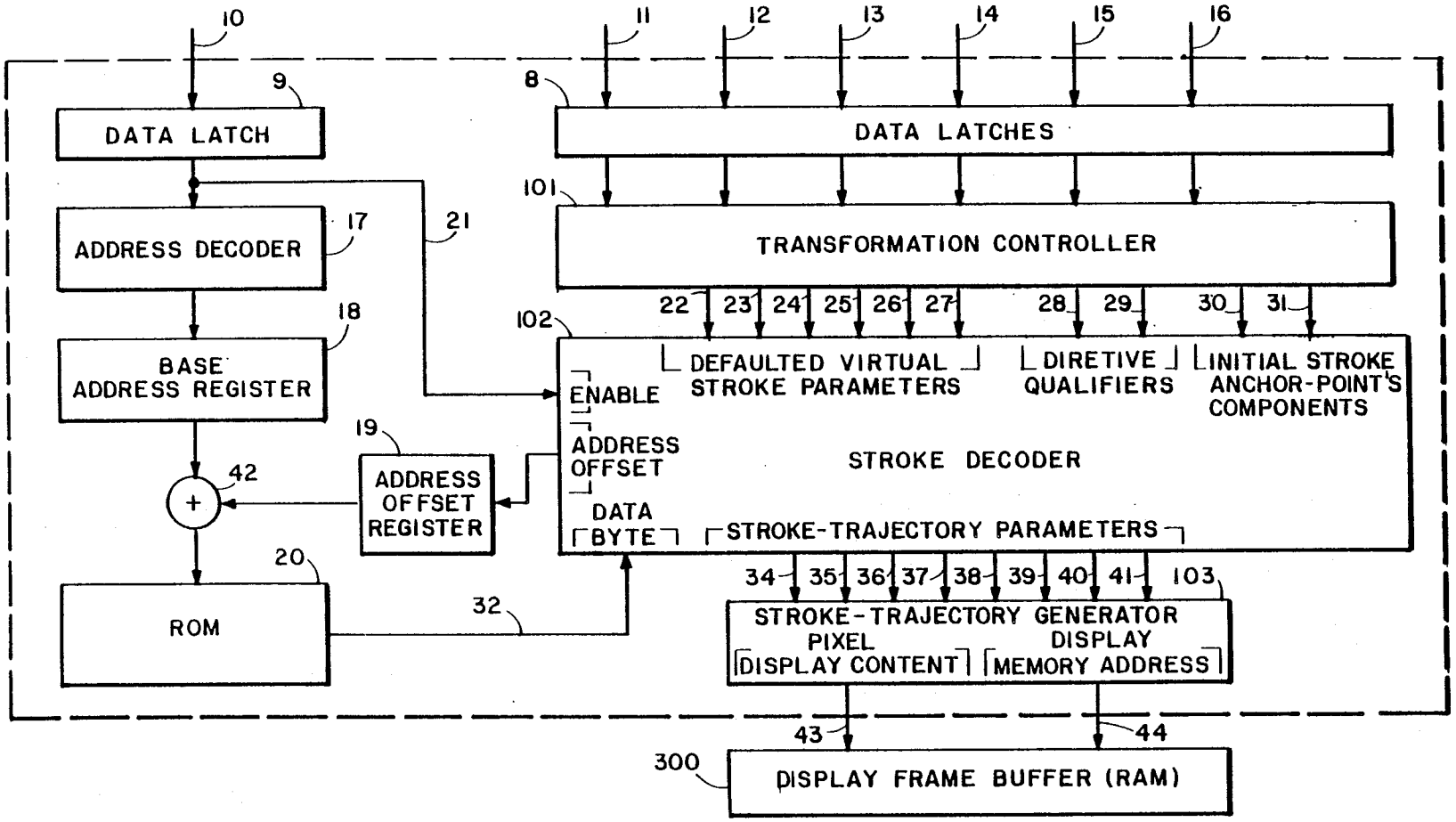
FIG. 2 is a functional block diagram of the preferred embodiment of the stroke-vector character generator.

Before describing in detail the stroke-vector character generator in FIG. 2, it is helpful to have a more complete definition of certain expressions and an explanation of certain videotex concepts. Any terms not specifically defined shall have the meanings provided in the 1983 version of the NAPLPS.

Several forms of character transformations are possible in the preferred embodiment of this invention: character scaling, rotation, and reflection. (For transformations in general see Ch. 6 in Newman and Sproull referenced above.) Character rotation is limited herein to four discrete rotations: 0°, 90°, 180° and 270°. A character reflection transformation is the mirror image of the character field and is limited to a relection about either the vertical or the horizontal center axes of the character field.

Stroke Attributes

For a given stroke anchor point or character drawing point, as few as eleven stroke attributes can uniquely define a stroke. They are:

1. the length of the horizontal component vector (designated herein as DX-LENGTH);
2. the length of the vertical component vector (designated herein as DY-LENGTH);
3. the sign of the horizontal component vector (designated herein as DX-SIGN);
4. the sign of the vertical component vector (designated herein as DY-SIGN);
5. the existence status of the horizontal component vector (designated herein as DX-EXIST-STATUS);
6. the existence status of the vertical component vector (designated herein as DY-EXIST-STATUS);
7. the length of the logical-pel's horizontal displacement from the stroke's locus (designated herein as PELX-LENGTH);
8. the length of the logical-pel's vertical displacement from the stroke's locus (designated herein as PELY-LENGTH);
9. the sign of the logical-pel's horizontal displacement from the stroke's locus (designated herein as PELX-SIGN);
10. the sign of the logical-pel's vertical displacement from the stroke's locus (designated herein as PELY-SIGN); and
11. the stroke visibility status (designated herein as VISIBILITY-STATUS).

While the stroke anchor point and the lengths and signs of the DX and DY component vectors completely describe the length and the direction of a stroke-vector, the lengths and signs of the logical pel's displacements from the stroke's locus completely describe the width dimension of a stroke. Finally, the VISIBILITY STATUS of a stroke describes whether a stroke is made visible or invisible on the display screen.

The following Table 1 lists the type and the range of values that have been assigned to each stroke attribute in the preferred embodiment of this invention.

TABLE 1

| Stroke Attribute | Type of Values | Range of Values |
|---|---|---|
| DX-LENGTH | numerical valued | 0 < DX-LENGTH < HPR* |
| DY-LENGTH | numerical valued | 0 < DY-LENGTH < VPR** |
| PELX-LENGTH | numerical valued | 0 < DX-LENGTH < HPR* |
| PELY-LENGTH | numerical valued | 0 < DY-LENGTH < VPR** |
| DX-SIGN | binary valued | + or − |
| DY-SIGN | binary valued | + or − |
| PELX-SIGN | binary valued | + or − |
| PELY-SIGN | binary valued | + or − |
| DX-EXIST-STATUS | binary valued | true or false |
| DY-EXIST-STATUS | binary valued | true or false |
| VISIBILITY-STATUS | binary | visible or invisible |

TABLE 1-continued

| Stroke Attribute | Type of Values | Range of Values |
|---|---|---|
| | valued | |

*HPR = Horizontal Pixel Resolution
**VPR = Vertical Pixel Resolution

While DX-LENGTH, DY-LENGTH, PELX-LENGTH and PELY-LENGTH are numerically valued, all the other attributes can be (and are in the preferred embodiment) assigned binary values. This is an important distinction as will be seen. The value of DX-EXIST-STATUS and DY-EXIST-STATUS is either "true" or "false" (i.e. an X or Y component either exists or it does not exist). The value of DX-SIGN, DY-SIGN, PELX-SIGN and PELY-SIGN is either "positive" or "negative." Finally, the VISIBILITY-STATUS can be either "visible" or "invisible" (i.e. the composing pixels are either turned ON or OFF).

Except for the PELX-SIGN and PELY-SIGN, all of the stroke attributes are dependent upon either the character field size or the character shape. The PELX-SIGN and PELY-SIGN attributes depend on the logical-pel's geometric alignment with respect to the stroke locus. The following four stroke attributes are global attributes (i.e. character-field-size dependent): DX-LENGTH, DY-LENGTH, PELX-LENGTH and PELY-LENGTH. The remaining five stroke attributes are nonglobal (i.e. character-shape dependent): DX-SIGN, DY-SIGN, DX-EXIST-STATUS, DY-EXIST-STATUS, and VISIBILITY-STATUS.

In the preferred embodiment for any particular character field sizes the lengths of the horizontal strokes and the lengths of the horizontal component vectors of the diagonal strokes are uniform, and this constant length is given by the global attributive value of DX-LENGTH. Similarly, the lengths of the vertical strokes and the lengths of the vertical component vectors of the diagonal strokes are uniform, and this constant length is given by the global attributive value of DY-LENGTH. Although the lengths of all horizontal stroke-vectors are equal and the lengths of all vertical stroke-vectors are equal, the length of each horizontal stroke-vector is not necessarily equal to the length of each vertical stroke-vector. For any particular character image, the character length of each horizontal stroke-vector and the exact length of each vertical stroke-vector is determined by and is proportional to the character field dimensions. In general there is no reason why certain variations in length of the stroke-vectors for a particular character image could not be tolerated by the system and may indeed even be desirable. For example, by increasing the length of each horizontal stroke-vector, the resulting character image may take on a different "stylized" appearance.

The horizontal displacement lengths of the logical-pels are uniform, and this constant length is given by the global attributive value of PELX-LENGTH. Similarly the vertical displacement lengths of the logical-pels are uniform, and this constant length is given by the global attributive value of PELY-LENGTH. In the preferred embodiment, the global attributive values of DX-LENGTH and PELX-LENGTH are equal, and the global attributive values of DY-LENGTH and PELY-LENGTH are equal. Since the character field is defined to be the rectangular display area within which the image of a character can be defined, for given character field dimensions, the global attributive values of DX-LENGTH and DY-LENGTH will depend respectively on the allowable horizontal-stroke span and the allowable vertical stroke span which can be defined within the character field.

Figure 9:
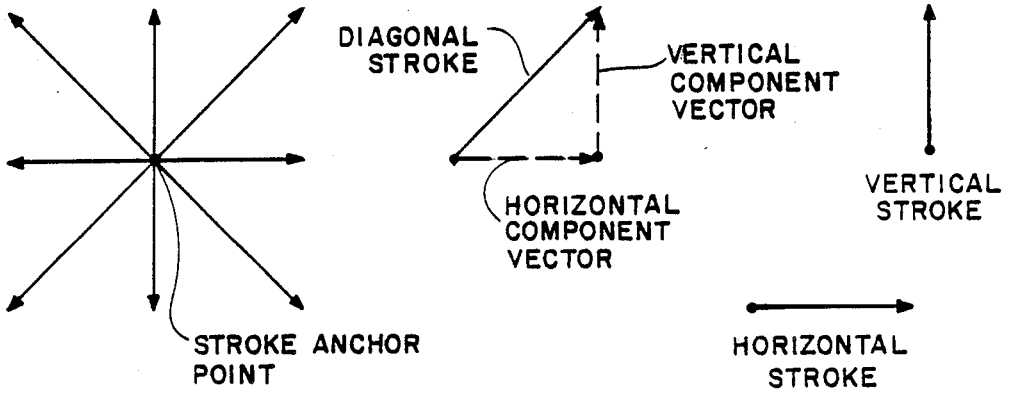
FIG. 9 illustrates, for a given character field size, the eight possible stroke directions from a single point in the preferred embodiment of this invention.
Figure 10:
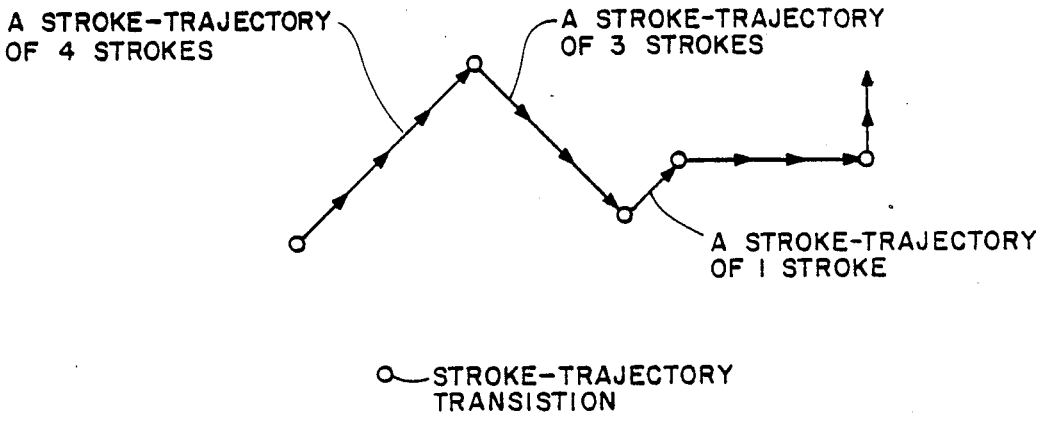
FIG. 10 is a diagram illustrating the graphic concept of stroke-trajectory transition.
Figure 11:
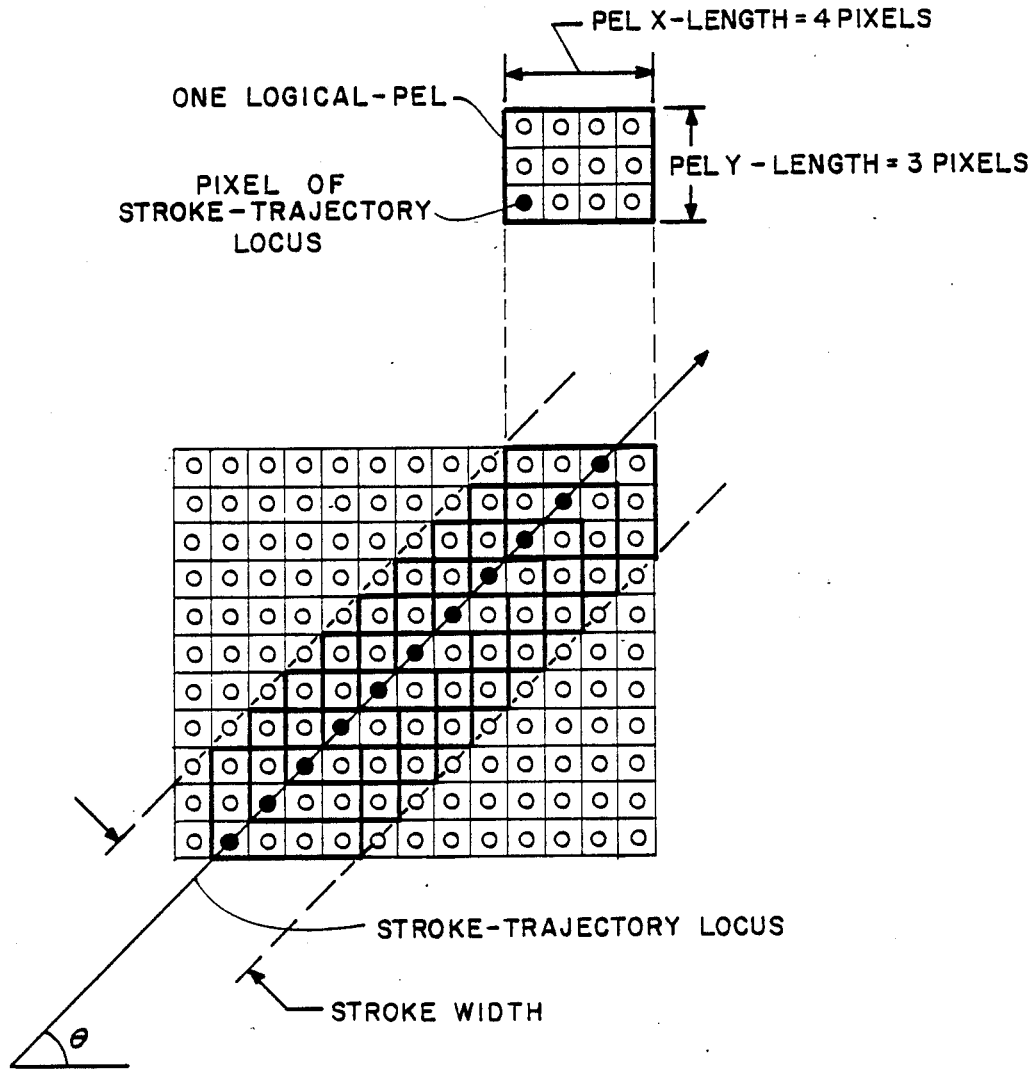
FIG. 11 is a diagram which illustrates for a diagonal stroke-trajectory the creation of stroke width by mapping continuously each pixel into a logical-pel.
Figure 12:
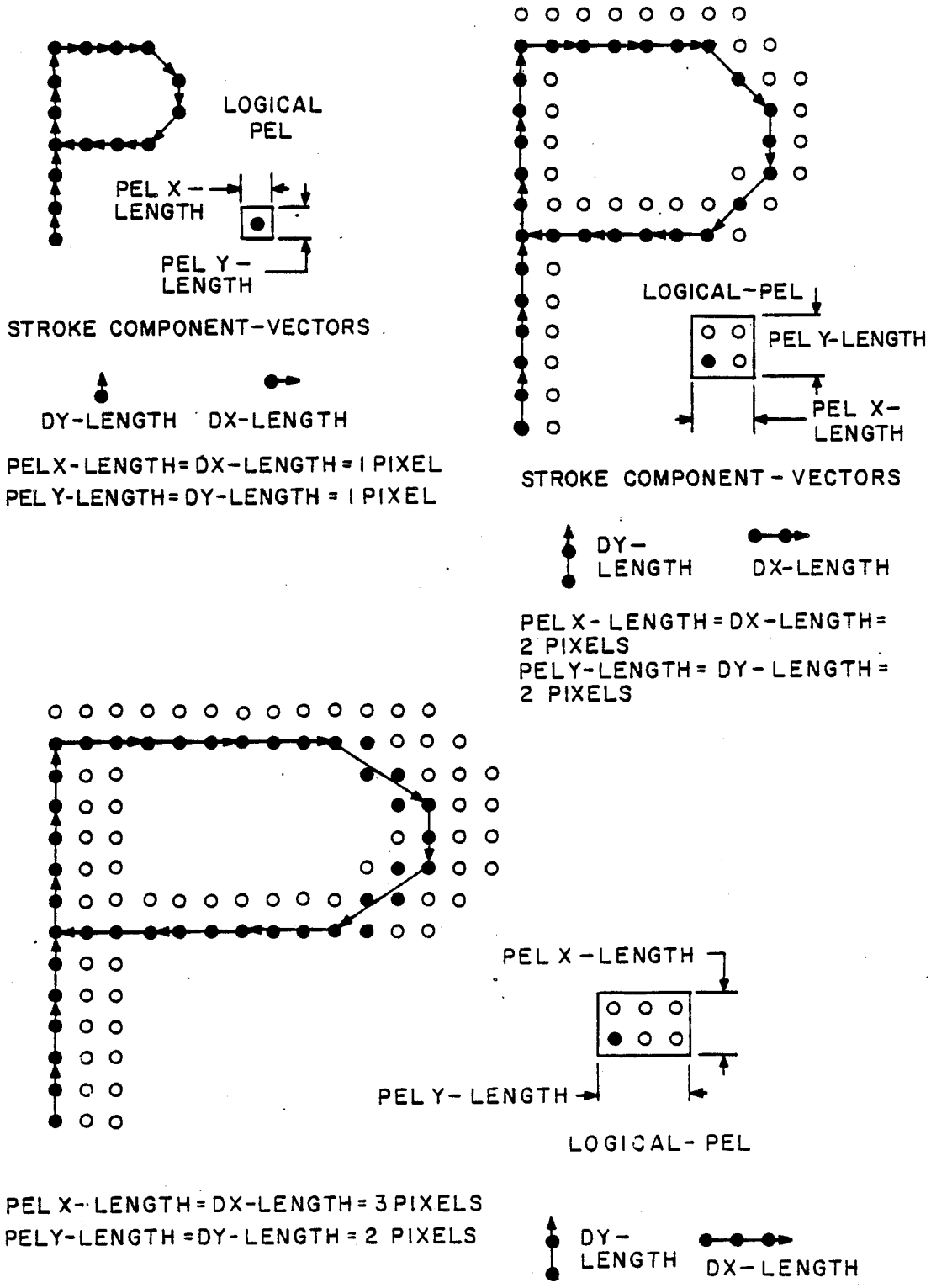
FIG. 12 illustrates, for different sets of stroke vector lengths and logical-pel sizes the resulting image sizes of the character "P".

Referring to FIG. 9, the left diagram illustrates the eight possible stroke directions from a single point. The three right diagrams show a diagonal stroke (both DX and DY component vectors exist), a horizontal stroke (only the horizontal component vector exists), and a vertical stroke (only the vertical component vector exists). The eight possible strokes from a single point consist of four diagonal strokes, two horizontal strokes and two vertical strokes.

The following Table 2 shows that the three states of a diagonal stroke, a horizontal stroke and a vertical stroke are specified by the two stroke attributes: DX-EXIST-STATUS and DY-EXIST-STATUS. It should be noted however that although the DX-EXIST-STATUS and the DY-EXIST-STATUS stroke attributes represent the x and y component vectors, the True/False coding of these attributes must be interpreted together to determine whether one is "on" and the other is "off". Also the coding is such that there are only three possible states, i.e. the fourth state (both vectors nonexistent) is not allowed.

TABLE 2

| STROKE ATTRIBUTES | | |
|---|---|---|
| DX-EXIST-STATUS | DY-EXIST-STATUS | RESULTANT STROKE-VECTOR |
| True | True | A diagonal stroke with |
| False | False | both horizontal and vertical component vectors |
| True | False | A horizontal stroke with horizontal component vector only |
| False | True | A vertical stroke with vertical component vector only |

When DX-EXIST-STATUS and DY-EXIST-STATUS are either both "true" or "false," a diagonal stroke is created. When the DX-EXIST-STATUS is "true" and the DY-EXIST-STATUS is "false," a horizontal stroke is created. In this situation, the two attributes, DY-LENGTH and DY-SIGN, are in effect void, since a horizontal stroke does not have a vertical component Vector. When the DX-EXIST-STATUS is "false" and the DY-EXIST-STATUS is "true," a vertical stroke is created. Under this situation the two attributes, DX-LENGTH and DX-SIGN, are in effect void, since a vertical stroke does not have a horizontal component vector.

The manipulation of the stroke visibility attribute is very useful in actually plotting characters on a display screen. When a stroke is visible, it is eventually plotted and made visible on the display. When a stroke is invisible, it is plotted but not made visible on the display screen. The invisible stroke is provided to complement the visible strokes so that the image of a character can be defined by a series of visible and invisible strokes. For example, when drawing an "L", an unbroken series of visible strokes beginning at the upper or lower end of the "L" and continuing to the opposite end are used. However, when drawing for example the letter "A", it is necessary to use invisible strokes to prevent visibly overlapping previously drawn portions of the character when drawing the horizontal bar of the "A". This process is analogous to that used when using a pencil and paper to draw an "A". When using a pencil and paper to draw an "A", one typically draws the outside legs of the character (the visible strokes), then lifts the pencil (invisible strokes) and then lowers it to draw the horizontal bar (the visible strokes).

Character Generator

The raster-scan stroke-vector character generator 100, shown in FIG. 1, may be separated into the following functional units shown in the block diagram in FIG. 2: (1) transformation controller 101; (2) stroke decoder 102; (3) stroke-trajectory generator 103; and (4) a read only memory (ROM) 20 containing the plurality of variable-length microprograms which encode stroke-drawing directives.

The I/O interface 60 in FIG. 1 receives the input interface signals and sends them via the system bus 110 to the character generator 100. These input signals could be initially entered through input interfaces such as encoders and buffers from any number of various external input devices such as a keyboard, a mouse, etc. The signal format depends upon the system protocol adopted. The North American Presentation Level Protocol Syntax (NAPLPS) is one of several protocols that set a "standard" for the format of such data signals. Referring to the top of FIG. 2, there are seven input data lines (10–17) to the character generator 100 on which the character input signals are applied. These seven individual signals designate: a character address, on input line 10; an (x,y) coordinate representing the character drawing point, on input lines 15 and 16; a character rotation, on input line 13; a character reflection, on input line 14; a character field horizontal dimension (x coordinate) on input line 11; and a character field vertical dimension (y coordinate) on input line 12.

Figure 25:
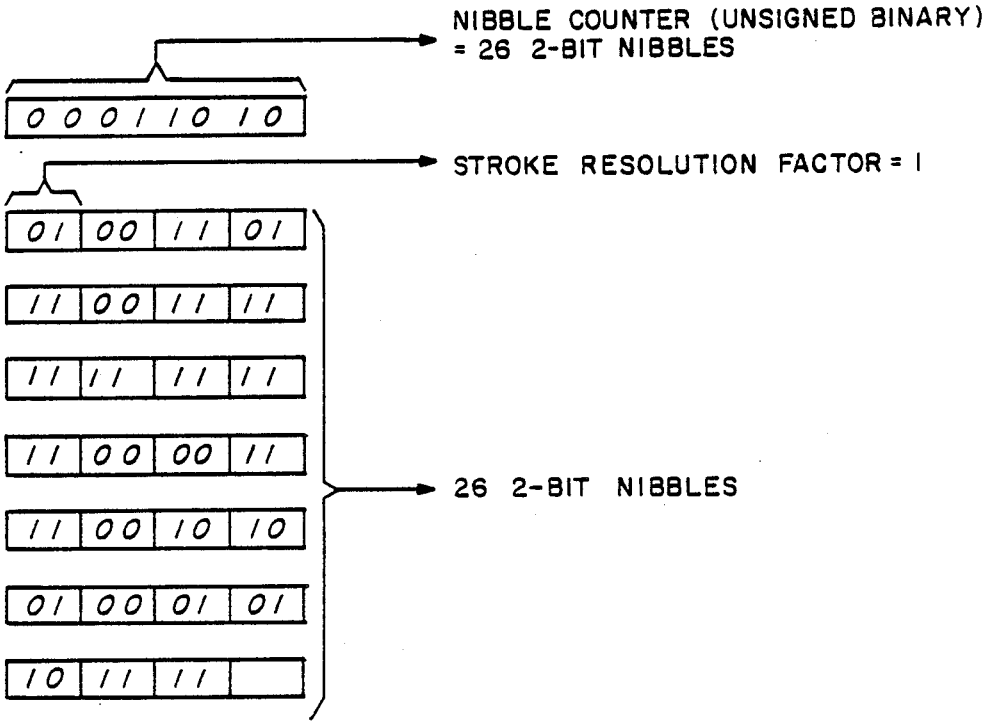
FIG. 25 illustrates the format and the contents of the microprogram of the relative stroke drawing directives for the alpha character "P".
Figure 26:
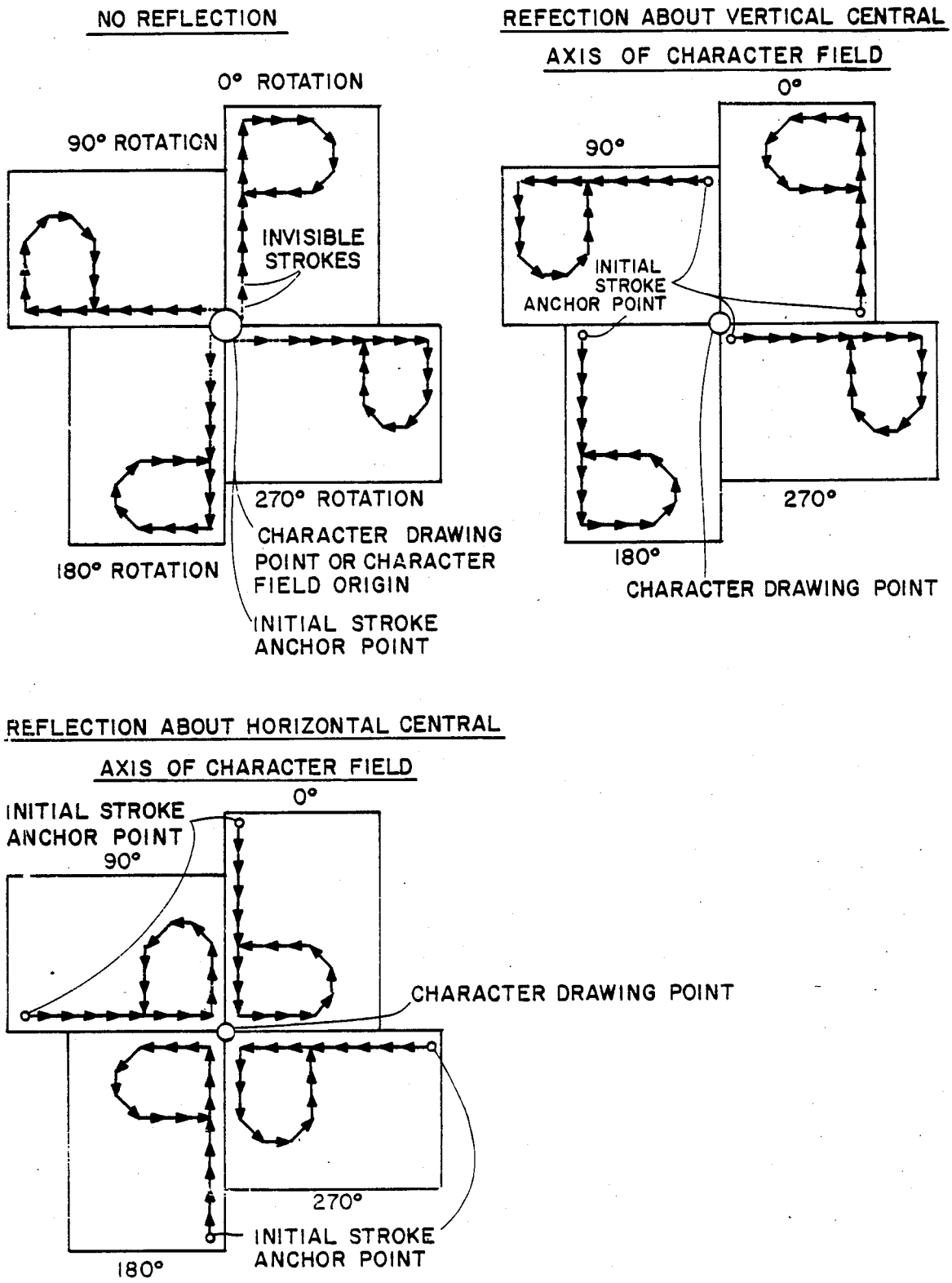
FIG. 26 illustrates, for different variations of character rotation and character reflection, the twelve possible character image variations resulting from the interpretation of the single microprogram for the character "P".

The character code on input 10 is an 8-bit word corresponding to a particular ANSI character code and representing a character such as the letter "P". (Although the ANSI code is used, any other protocol could be used equally well.) The character code signal, clocked through data latch 9, is applied to address decoder 17. Address decoder 17 decodes the signal, i.e. recognizes the character type as the letter P, and searches an internal ROM data lookup table for an address corresponding to the decoded character. For every microprogram that ROM 20 has stored in its memory, ROM 17 stores the starting (or base) address for the particular microprogram to be accessed. The signal representing the starting address from decoder 17 is loaded in the base address register 18. The address offset register 19 increments the base address after the decoding of that byte so that each byte or line of memory from ROM 20 can be accessed and loaded, one byte at a time, into stroke decoder 102 via path 32. ROM 20 contains a variable-byte microprogram for each character to be represented, with each microprogram being a plurality of encoded binary valued stroke-drawing directives. FIG. 25 shows the coded contents of a typical microprogram stored in ROM 20. (The format of the microprograms and the relative stroke-drawing directives are described below.) In summary the character code on input line 10 serves as an index into a table of addresses of a plurality of microprograms that contain drawing directives for the character being addressed.

Relative Stroke-Drawing Directives

To understand the function of the relative stroke drawing directives stored in ROM 20, first consider what happens to the stroke attributes when a character is drawn. When the current stroke is on the same stroke-trajectory as the preceding stroke, the current stroke has the same set of attributive values as the preceding stroke. When the current stroke encounters a stroke-trajectory transition, some of the nonglobal attributes have to change. But, the values of all the global attributes stay constant in defining all the strokes of a character image.

Using these observations, the relative value changes in the nonglobal attributive values between the current stroke and the preceding stroke have been broken down into a set of seven binary valued stroke-vector operators which are called herein relative stroke-drawing directives. These seven relative stroke-drawing directives are encoded by a variable-length code composed of three 2-bit code words (01, 10, 11); and four 4-bit code words (0000, 0001, 0010, 0011). The meaning of these directives and the encoding scheme used are as follows.

TABLE 3

| Code Words | Relative Stroke-Drawing Directives |
|---|---|
| 01 | Switch the binary attributive value of DX-EXIST-STATUS; |
| 10 | Switch the binary attributive value of DY-EXIST-STATUS; |
| 11 | no change; |
| 0000 | Switch the binary attributive values of DX-EXIST-STATUS and DY-EXIST-STATUS; |
| 0001 | Switch the binary attributive value of DX-SIGN; |
| 0010 | Switch the binary attributive value of DY-SIGN; and |
| 0011 | Switch the binary attributive value of VISIBILITY-STATUS |

Due to the inherent nature of the relative stroke-drawing directives, the nonglobal attributes of all the strokes that make up a character image are chain-related. Consequently, by applying a desired set of transformations to the nonglobal attributes of the defaulted virtual stroke and by applying this set of transformed attributes to the stroke decoder, the desired transformation adjustments of the nonglobal stroke attributes of the succeeding strokes will be carried out automatically by the stroke decoder. On the other hand, for a given set of character input values, by applying the corresponding transformed set of constant global values of the global stroke attributes to the decoder, the set of transformation adjustments of the global stroke attributes of all the strokes will be transparent to the decoder. (This will be explained in detail hereinafter.)

Transformation Controller

The transformation controller 101 performs several operations analagous to a lookup table function and could be implemented with several ROMs. There are six input signals to the transformation controller designating: the character horizontal field dimension, on line 11; the character vertical field dimension, on line 12; the character rotation, on line 13; the character reflection, on line 14; and the (x,y) components of the character drawing point on lines 15 and 16. Based upon the particular set of character input signals the transformation controller establishes the defaulted virtual stroke parameters (on output lines 22–27); the directive qualifiers (on output lines 28 and 29); and the initial stroke anchor points components in the virtual-pixel screen, (on output lines 30 and 31). The transformation controller is invoked whenever there is a change in one of the character input signals. More specifically, the six transformed stroke attributes of the defaulted virtual stroke are:

DX-EXIST-STATUS (on line 22),
DY-EXIST-STATUS (on line 23),
DX-SIGN (on line 24),
DY-SIGN (on line 25),
DX-LENGTH (on line 26), and
DY-LENGTH (on line 27).

Since the microprograms stored in ROM 20 contain only changes in the stroke attributes from one stroke to the next, the stroke decoder 102 has to establish an initial set of nonglobal attributes to which it can apply the drawing directives. It can be considered that the initial stroke is preceded by a virtual (imaginary) stroke defined by a default set of nonglobal attributive values. (Except for VISIBILITY-STATUS which is always defaulted to be "visible," the defaulted nonglobal attributive values are affected by the rotation and reflection transformations applied to a character image.) The table in FIG. 21 shows the various default stroke attributive values for all character rotations and reflections permitted in the preferred embodiment.

Referring to FIG. 3, the first function of the transformation controller 101 is coordinate-system mapping to establish the initial stroke anchor points. The (x,y) components of the character drawing point, and the input values of the character field horizontal and vertical dimensions are defined by the coding or numbering system of the input data signals (on paths 11, 12, 15, and 16) which may or may not be the same as the physical-pixel screen coordinate system. If the two systems are not the same, some form of translation is necessary. However, the transformation controller 101 performs a conversion from whatever number system is used to a virtual-pixel coordinate system. In the preferred embodiment, the transformation controller 101 maps these four 8-bit input data signals into the corresponding values based on the 14-bit virtual-pixel screen numbering system. (The reason for the virtual-pixel screen is to reduce truncation errors due to scaling. This is explained in more detail in connection with the stroke decoder operation.)

The second function of the transformation controller is to transform the character drawing point (defined by the two-byte signals on paths 15 and 16) into the initial stroke anchor point in accordance with the set of input transformation signals on paths 13–14. When there is no character transformation, the character drawing point defines the initial stroke anchor point. When the input reflection signal indicates a reflection transformation, it is necessary to apply translation transformation to the initial stroke anchor point. The table in FIG. 22 illustrates, for a given rotation transformation signal and a given reflection transformation signal, the required translation transformation to obtain the initial stroke anchor point based upon the location of the character drawing point.

The third function of the transformation controller as shown in FIG. 24, is to modify the interpretations of the two relative stroke-drawing directives code words, 0001 and 0010 when required by the input transformation signals. When there is no character transformation, the directive code word 0001 is interpreted to switch the binary attributive value of the sign of the horizontal component vector (DX-SIGN), and the directive code word of 0010 is interpreted to change the binary attributive value of the sign of the vertical component vector (DY-SIGN). Referring to FIG. 18, when a horizontal component vector is rotated 90° or 270°, it is transformed into a vertical component vector. Similarly, when a vertical component vector is rotated 90° or 270°, it also is transformed into a horizontal component vector. Consequently, when the input rotation signal indicates a character rotation of 90° or 270°, the interpretations of these two directive code words should be interchanged.

The directive code words are interpreted by the stroke decoder 102. In order to modify its interpretations of the two directive code words 0001 and 0010, two 4-bit directive qualifiers are supplied by the transformation controller. The two directive qualifiers are designated respectively as DX-SIGN-QUALIFIER and DY-SIGN-QUALIFIER (in FIG. 24.). Instead of checking a 4-bit code against all four 4-bit code words, it is checked against the two 4-bit code words (0000 and 0011) and the bit-sequences of the two 4-bit directive qualifiers. Each of the directive qualifier sequence can assume a bit-sequence of either 0001 or 0010. When a 4-bit code matches the bit-sequence of the DX-SIGN-QUALIFIER, the binary attributive value of the sign of the horizontal component vector is switched. Similarly, when a 4-bit code matches the bit sequence of the DY-SIGN-QUALIFIER, the binary attributive value of the sign of the vertical component vector is switched. Referring to FIG. 24, the two tables illustrate that the two directive qualifiers (DX-SIGN-QUALIFIER and DY-SIGN-QUALIFIER) control the decoding of the two 4-bit stroke-drawing directive code words (0001 and 0010).

According to the value of the character rotation signal, transformation controller 101 sets up on paths 28 and 29 the bit-sequences of the two directive qualifiers. When the character rotation signal on input path 13 indicates a rotation of 0° or 180° DX-SIGN-QUALIFIER is set up as 0001 and DX-SIGN-QUALIFIER is set up as 0010. Or, when the character rotation signal indicates a rotation of 90° or 270°, DY-SIGN-QUALIFIER is set up as 0010 and DY-SIGN-QUALIFIER is set up as 0001. Referring to FIG. 23, the table illustrates the required settings of the two 4-bit directive qualifiers for each of the four possible character rotations.

The fourth function of the transformation controller 101 is to modify the stroke attributes of the defaulted virtual stroke in accordance with the character input signals. Though ten stroke attributes are involved with transformation adjustments, the transformation controller needs only six in the preferred embodiment because: (1) the constant global attributive values of DX-LENGTH and PELX-LENGTH are set equal to each other; (2) the constant global attributive values of DY-LENGTH and PELY-LENGTH are also set equal to each other; (3) the constant global attributive value of PELX-SIGN is made equal to the transformed attributive value of DX-SIGN of the defaulted virtual stroke; and (4) the constant global attributive value of PELY-SIGN is set equal to the transformed attributive value of DY-SIGN of the defaulted virtual stroke (see FIG. 21).

Stroke Decoder

Basically the function of the stroke decoder 102 is to determine the stroke-trajectories of a character image by constructing the nonglobal attributive values through the interpretation of the relative stroke-drawing directives encoded in ROM 20, and by applying the set of constant global attributive values which are applicable to each stroke.

Referring to FIG. 2, when a character address 10 (8 bits) is latched into a data latch, address decoder 17 and the stroke decoder 102 are enabled. For a given character address input, the address decoder 17 generates a microprogram base address which is loaded into the base address register 18. By adding an offset to the base address, the stroke decoder 102 can access any particular byte of the microprogram. This enables the stroke decoder 102 to retrieve and store each byte of the encoded relative stroke-drawing directives for the character to be displayed when required by the particular operation step of the stroke decoder 102.

At any one time, stroke decoder 102 can be in either the dormant phase or the execution phase. In the dormant phase, it accepts on input paths 22–27 the six transformed stroke attributes of the defaulted virtual stroke from the transformation controller 101. Once stroke decoder 102 is enabled by the character address on path 21, it will freeze the inputs from the transformation controller 101 and enter into the execution phase of reconstructing the series of strokes for the character image identified. The execution phase consists of two processes: an initialization process followed by a decoding process. The initialization process initializes the required status registers, control registers and counters prior to interpreting any of the drawing directives. The decoding process decodes the relative stroke directives encoded in the microprogram indexed by the subject character address. (Because of the nature of these functions, stroke decoder 102 is software implemented on CPU 800 in the preferred embodiment.)

Figure 4:
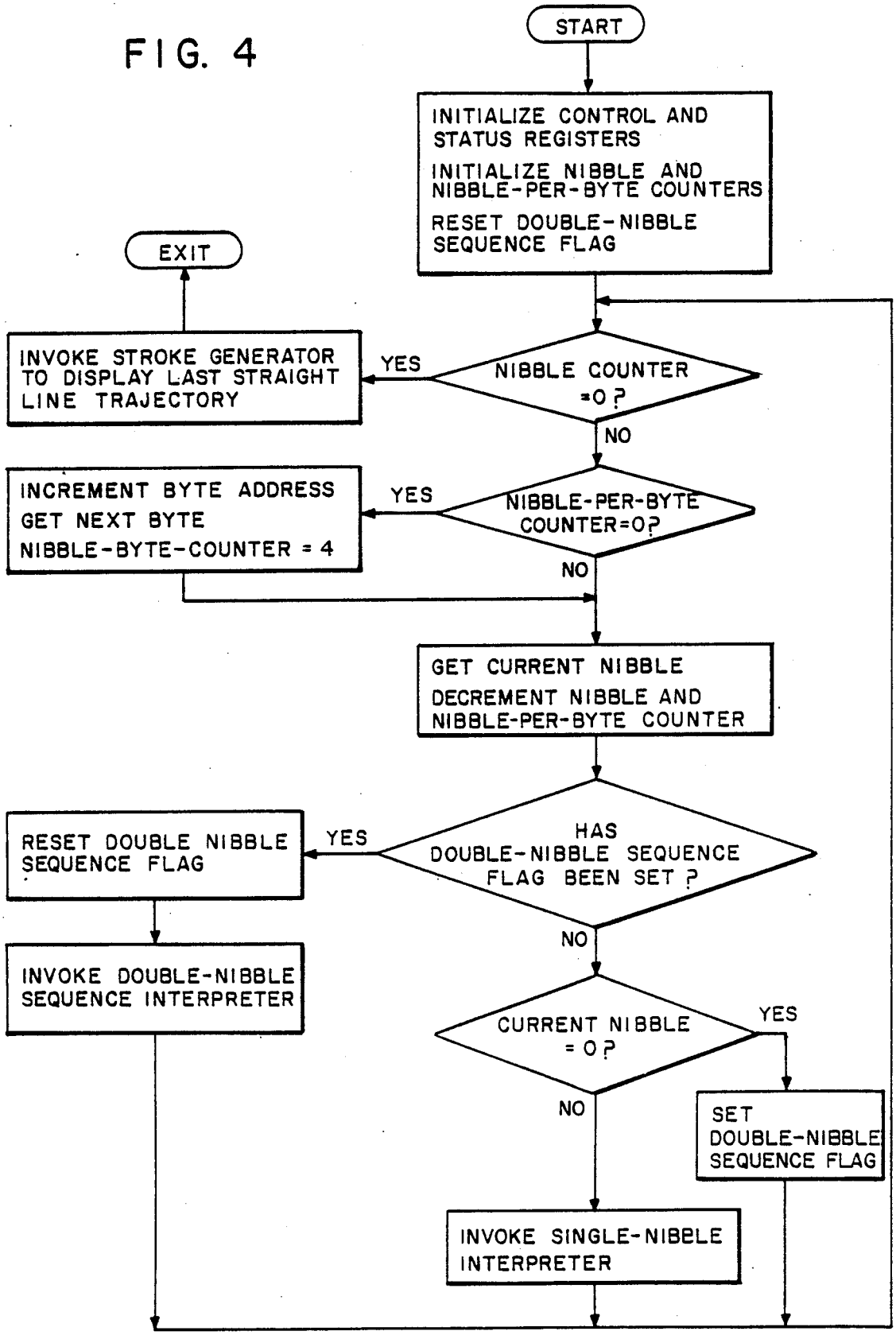
FIG. 4, FIG. 5 and FIG. 6 are the three operational flow-charts illustrating the detailed functional operations of the stroke decoder.
Figure 5:
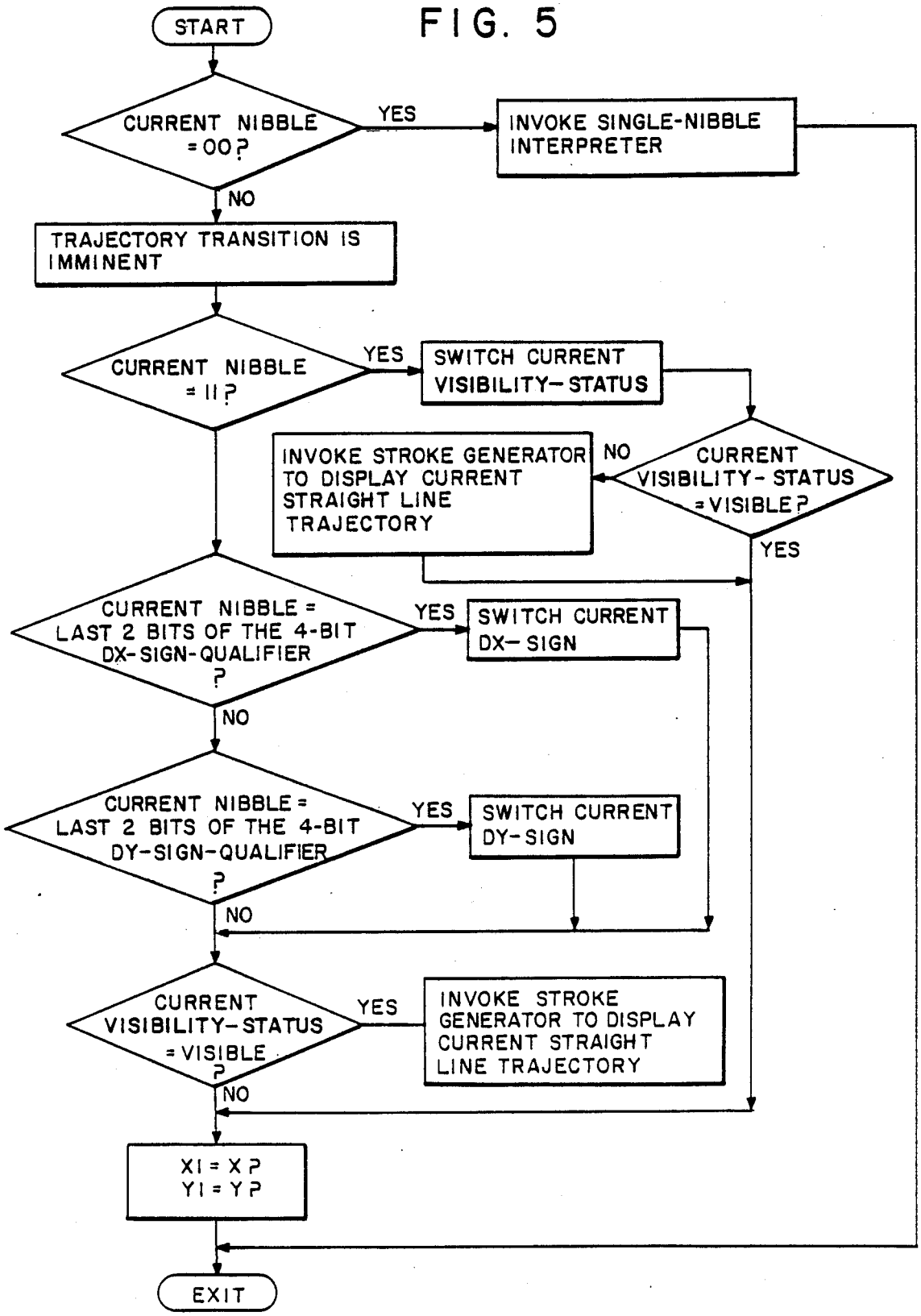
Figure 6:
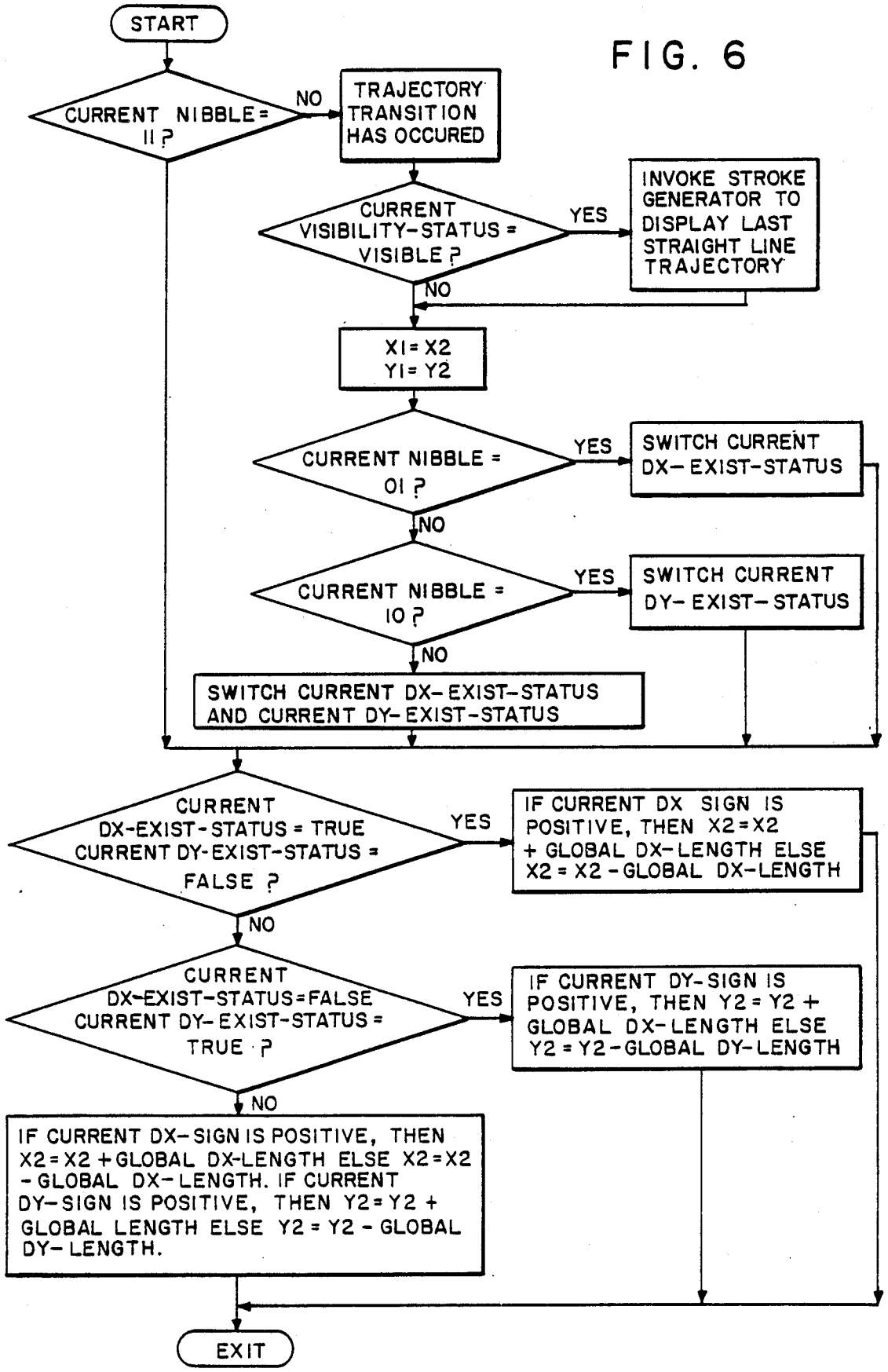

Referring to FIG. 4, FIG. 5 and FIG. 6, the first activity of the initialization process is to initialize five internal control registers: CURRENT DX-SIGN, CURRENT DY-SIGN, CURRENT DX-EXIST-STATUS, CURRENT DY-EXIST-STATUS and CURRENT VISIBILITY-STATUS; which will continuously keep track of the respective current in-use values of the five nonglobal attributes. The initialization values of CURRENT DX-EXIST-STATUS, CURRENT DY-EXIST-STATUS, CURRENT DX-SIGN and CURRENT DY-SIGN are equal respectively to the values of the four input signals: DEFAULTED DX-EXIST-STATUS, DEFAULTED DY-EXIST-STATUS, DEFAULTED DX-SIGN and DEFAULTED DY-SIGN. CURRENT VISIBILITY-STATUS is always initialized to be "visible."

The second activity of the initialization process is to initialize the two internal status registers, GLOBAL DX-LENGTH and GLOBAL DY-LENGTH, which contain the constant global values for the character-field-size dependent attributes of DX-LENGTH and DY-LENGTH. These two global attributive values stay constant in defining the strokes of a character image and they cannot be changed by the relative drawing directives encoded in the corresponding microprogram. First, the stroke resolution factor is obtained by interpreting the first two bits of the second byte of the microprogram. Second, GLOBAL DX-LENGTH and GLOBAL DY-LENGTH are initialized respectively by multiplying the two input signals, DX-LENGTH and DY-LENGTH, by the stroke resolution factor.

There is no need to reserve internal status registers for containing the logical-pel parameters because: (1) GLOBAL PELX-LENGTH and GLOBAL PELY-LENGTH, which are the global attributive values for the PELX-LENGTH and PELY-LENGTH, are equal respectively to the GLOBAL DX-LENGTH and GLOBAL DY-LENGTH; (2) GLOBAL PELX-SIGN and GLOBAL PELY-SIGN, which are the constant global attributive values for the PELX-SIGN and PELY-SIGN, are equal respectively to the DEFAULTED DX-SIGN and DEFAULTED DY-SIGN.

The third activity of the initialization process is to initialize the nibble counter and the nibble-per-byte counter; each counter is represented as an 8-bit unsigned integer value. Any synchronous 2-bit sequence of the input stroke-drawing directive code sequence is designated as a nibble. The stroke-drawing directive codes are composed of three 2-bit code words (single nibble) and four 4-bit code words (double nibbles) as shown in Table 3 above. The nibble counter indicates the number of nibbles left to be decoded. As shown in the example of the letter "P" in FIG. 25, the unsigned integer value of the first byte of a microprogram indicates the total number of nibbles to be decoded; and the nibble counter is initialized to this unsigned value.

Except for the first and last bytes of the stroke-drawing directive microprogram, all stroke-drawing directive bytes contain four successive 2-bit nibbles starting from the most significant bit to the least significant bit. The first stroke-drawing directive byte (2nd byte of the microprogram) contains three successive 2-bit nibbles starting from the third most significant bit to the least significant bit (the first 2-bit nibble being the stroke resolution factor). And the last stroke-drawing directive byte contains from one to four 2-bit nibbles starting from the most significant bit. An internal nibble-per-byte counter keeps track of the number of 2-bit nibbles left in the current stroke directive byte. The nibble-per-byte counter is initialized to three nibbles which compose the first stroke-drawing directive byte.

The fourth activity of the initialization process is to initialize the double-nibble sequence flag. Recall that the relative stroke-drawing directives are encoded by either single-nibble codes (2 bits) or double-nibble sequence codes (4 bits). The double-nibble sequence flag is set when the header nibble (00) of the double-nibble sequence is encountered, and the sequence flag is reset after the interpretation of the double-nibble sequence. The double-nibble sequence flag must be reset during the initialization process to insure that the flag is in the proper state prior to interpreting a single or a double nibble sequence.

Referring to FIG. 4, FIG. 5 and FIG. 6, the decoding of the stroke-drawing directives process is illustrated by a series of flow charts. The decoding process is characterized by finite cyclic operational phase sequences. For most of the cycles of the decoding process, three successive operational phrases can be identified.

Referring first to FIG. 4, the first operational phase of a decoding cycle can be identified as the nibble data acquisition. From an 8-bit stroke directive byte, a 2-bit nibble is extracted and stored as an 8-bit data byte which can take on a hexadecimal value of 00, 40, 80 or C0. Before acquiring any nibble data, the nibble counter is first checked. If the nibble counter equals zero, the whole decoding process is terminated and the stroke generator 103 displays the last straight line trajectory in the physical pixel screen.

Referring to the flow chart of FIG. 4, if nibble-per-byte counter equals zero, a new stroke-drawing directive byte is read out of ROM 20 from the current in-use microprogram and the nibble-per-byte counter is initialized to four nibbles. An 8-bit data, current nibble byte, will be formed by the logical "AND" operation between the current directive byte and the byte mask of 110000000. As a result, the current 2-bit nibble, CURRENT-NIBBLE, is transferred to the two most significant bits of the current nibble byte. After the extraction of the CURRENT-NIBBLE, the current directive byte is logically shifted left by 2 bits. Thus the next-to-be read nibble will occupy the two most significant bits of the current directive byte.

The second operation phase of the decoding process is to decide whether to invoke the single-nibble interpreter or the double-nibble sequence interpreter. If the double-nibble header flag is set, then the double-nibble sequence interpreter is invoked and the flag is reset. If the CURRENT-NIBBLE is not equal to 00, then the single-nibble interpreter is invoked. Otherwise, the double-nibble header flag is set and the next decoding cycle will proceeds.

The third operation phase of the decoding process is the single-nibble interpretation or the double-nibble sequence interpretation. When the third operation phase is finished, a new decoding cycle will start by proceeding to the first operation phase of nibble data acquisition.

Referring to the flow chart in FIG. 5, the functional operation of the double-nibble sequence interpreter is shown. If the CURRENT-NIBBLE equals 00, an exit to the single nibble interpreter occurs. If the CURRENT-NIBBLE does not equal 00, a stroke-trajectory transition from the current stroke-trajectory to a new stroke-trajectory is imminent. (A stroke-trajectory transition, in terms of the stroke drawing directives, is defined to be a change in any one of the stroke drawing directives except for the "11" nibble—which means no change in any of the stroke attributes).

If the CURRENT-NIBBLE matches the last two bits of the 4-bit DX-SIGN-QUALIFIER, the binary value of the CURRENT-DX-SIGN is switched. If the CURRENT-NIBBLE matches the last two bits of the 4-bit DY-SIGN-QUALIFIER, the binary value of the CURRENT-DY-SIGN is switched. And, if the CURRENT-NIBBLE matches the "11" bit-sequence, the binary value of the CURRENT-VISIBILITY-STATUS is switched.

If a "visible-to-invisible" VISIBILITY-STATUS switching transition occurs or a sign switching transition occurs with the VISIBILITY-STATUS being visible, the stroke generator 103 displays each pixel of the current stroke-trajectory in the physical pixel screen. (The format of invoking the stroke generator will be explained later.) To prepare for the imminent trajectory transition, the anchor point of the new stroke-trajectory is updated by the tail point of the current stroke-trajectory.

Referring to the flow chart in FIG. 6, the functional operation of the single nibble interpreter is shown. The single-nibble interpreter determines whether a stroke-trajectory transition has ocurred by reading the value of the nibble code in the CURRENT-NIBBLE register. A stroke-trajectory transition is defined to be a change in any one of the stroke drawing directives except for the "11" nibble (which means no change in any of the stroke attributes). So, if the CURRENT NIBBLE is not equal to 11, a stroke trajectory transition has occurred. In that situation, two or more of the following events will occur: (1) if the CURRENT VISIBILITY-STATUS is visible, the stroke generator 103 displays the last stroke-trajectory in the physical pixel screen; (2) the anchor point of the current stroke-trajectory is given by the tail point of the last stroke-trajectory; and (3) the binary values of the CURRENT DX-EXIST-STATUS register or the CURRENT DY-EXIST-STATUS register are switched according to the CURRENT NIBBLE value. With or without the occurrence of a trajectory transition, a stroke has been added to the current stroke-trajectory. Therefore, it is necessary to update the tail point of the current stroke-trajectory. The tail point will be updated as follows: (1) update the x component only if the CURRENT DX-EXIST-STATUS is true; (2) update the y component only if the CURRENT DY-STATUS is true; and (3) update both the x and y components if the CURRENT DX-EXIST-STATUS and the CURRENT DY-EXIST-STATUS are either both true or both false. For a positive or negative CURRENT DX-SIGN, the tail point's x-component is incremented or decremented respectively by the GLOBAL DX-LENGTH. For a positive or negative CURRENT DY-SIGN, the tail point's y-component is incremented or decremented respectively by the GLOBAL DY-LENGTH.

Stroke-Trajectory Generator

The function of the stroke-trajectory generator 103 is to generate the stroke-trajectories on the physical-pixel screen. This is done whenever the stroke decoder 102 detects that a stroke-trajectory transition has occurred i.e. whenever any of the stroke drawing directive change (except for the "11" nibble code). The stroke decoder enables the stroke-trajectory generator 103 to display the current or the preceding stroke-trajectory in the physical-pixel screen between the present stroke starting point $(x_1,y_1)$ and the stroke tail point $(x_2,y_2)$. The drawn stroke will be visible if the value of the VISIBILITY STATUS of that stroke attribute is visible (i.e. ON). And the drawn stroke will be an invisible stroke if the value of the VISIBILITY-STATUS of that stroke is invisible i.e. OFF. Once the stroke-trajectory is drawn, (as either a visible or invisible stroke) the starting point is updated to the tail point. Note that the drawing of a stroke-trajectory may reduce to the drawing of a point where the starting point and the tail points are the same. For example if the stroke attribute DX-EXIST-STATUS is false (i.e. OFF) and the DX-SIGN is changed from + to −, a transition occurs by definition; however, the stroke starting point and tail points are the same so that the stroke drawn becomes a simple point.

The stroke-trajectory generator 103 will update the tail point of a stroke whenever a new stroke is defined, i.e. whenever the CURRENT-NIBBLE register is one of the following relative stroke directives:

| | |
|---|---|
| 01 | Switch the attributive value of DX-EXIST-STATUS; |
| 10 | Switch the attributive value of DY-EXIST-STATUS; |
| 11 | No change in DX- or DY-EXIST-STATUS; |
| 0000 | Switch the attributive value of both DX- and DY- |

-continued

EXIST-STATUS.

For each stroke-trajectory drawn, the stroke decoder 102 transmits the following eight stroke-trajectory values to the stroke-trajectory generator 103. Referring to FIG. 2, on paths 34 and 35 the signals designate the x- and y-components of the stroke-trajectory anchor points. The signals on paths 36 and 37 designate the x- and y-components of the stroke-trajectory tail point. The signals on paths 38 and 39 designate PELX-LENGTH and PELY-LENGTH. And, the signals on paths 40 and 41 designate PELX-SIGN and PELY-SIGN. The first four parameters convey the end-points of the straight line trajectory of each stroke vector. The last four parameters convey the lengths and signs of the logical-pel's horizontal and vertical displacements from the stroke-trajectory locus. Referring to FIG. 7, the block diagram illustrates the functional relationship of the input and output signals of the functional operations performed by the stroke-trajectory generator 103.

The first function of the stroke-trajectory generator 103 is coordinate-system mapping. While the stroke decoder 102 plots the end-points of a stroke in the virtual pixel coordinate system, the stroke trajectory generator 103 converts from one coordinate system to the other and displays the trajectory of strokes (with length and width) in the physical pixel coordinate system. Except for PELX-SIGN and PELY-SIGN, generator 103 maps the input parameter values based on the virtual-pixel coordinate system into the corresponding values based in the physical-pixel coordinate system. This function could be implemented with a digital divider circuit (in the preferred embodiment the divisor would be 64 as shown in FIG. 8). Of course there are many other ways this function could be implemented.

The second function of the stroke-trajectory generator 103 is to generate a signal to illuminate each pixel of the stroke-trajectory locus by a straight-line generator. In the preferred embodiment, the straight-line generator utilizes an algorithm commonly referred to as the Bresenham's algorithm. See the Newman and Sproull cited above, 2nd edition pp. 25–27.

The third and final function of the stroke-trajectory generator 103 is to map each pixel of the stroke-trajectory locus into a logical-pel based on the values of the PELX-LENGTH, PELY-LENGTH, PELX-SIGN and PELY-SIGN registers. (The alignment of the logical pel is shown in FIG. 13 in connection with the description of the rotation transformation which follows.) Referring again to FIG. 1, the stroke-trajectory generator 103 writes the display intensity information of each generated pixel into the corresponding pixel location in the display frame buffer 300. For each display refresh cycle, the display controller 200 scans frame buffer 300 and displays the intensity value of each pixel into the physical-pixel screen.

Stroke Resolution Factor

In any display system, the resolution or resolution factor is the degree to which the system can distinguish fineness of detail in a spatial pattern. In a stroke-vector display system the stroke resolution is a measure of the number of horizontal and vertical strokes available to compose a character image within a character field. In the preferred embodiment, for characters with moderate shapes, the horizontal and vertical stroke resolutions are restricted arbitrarily to be six uniform horizontal strokes and ten uniform vertical strokes respectively. This 6×10 pair of stroke resolutions is designated herein as the "normal pair" of stroke resolutions. Consequently, for a given pair of character field dimensions, the constant global attributive value of DX-LENGTH is obtained by dividing the horizontal stroke resolution into the given character field horizontal dimension. Similarly the constant global attributive value of DY-LENGTH is obtained by dividing the vertical stroke resolution into the given character field vertical dimension. For the normal pair of stroke resolutions, DX-LENGTH is one-sixth of the given character field horizontal dimension, and DY-LENGTH is one-tenth of the given character field vertical dimension.

The stroke resolution factor is determined by the complexity of the character shape. For complicated shaped characters, such as Oriental characters, it may be necessary to encode the character shape with a pair of stroke resolutions greater than that of the normal pair of stroke resolutions. On the other hand, for very simple shaped characters, it may be more efficient to encode the character shape with a pair of stroke resolutions less than that of the normal pair of stroke resolutions. In the preferred embodiment, four pairs of stroke resolutions are available: (1) the normal pair of stroke resolutions; (2) double the normal pair of stroke resolutions; (3) triple the normal pair of stroke resolutions; and (4) one-half of the normal pair of stroke resolutions. Each pair of stroke resolutions is specified by a stroke resolution factor which is a ratio of a pair of stroke resolutions to the normal pair of stroke resolutions. Consequently, the stroke resolution factor can take on the value of 1, 2, 3 or ½, and each is encoded into a 2-bit code. The table below illustrates the relationship between the horizontal and vertical stroke resolutions and the stroke resolution factor.

TABLE 4

ENCODING OF THE STROKE RESOLUTION FACTOR

| Code | Stroke Resolution | Horizontal Stroke Resolution* | Vertical Stroke Resolution** |
|---|---|---|---|
| 01 | 1 | 6 | 10 |
| 10 | 2 | 12 | 20 |
| 11 | 3 | 18 | 30 |
| 00 | ½ | 3 | 5 |

*(Horizontal-stroke span within a character field)
**(Vertical-stroke span within a character field)

As shown in FIG. 25, the 2-bit stroke resolution factor code appears as the first two bits of the second byte of the relative stroke directives microprograms stored in ROM 20. For example if the stroke resolution factor is 3, the global attributes DX-LENGTH and DY-LENGTH are multiplied by ⅓ in the stroke decoder 102 during the initialization process outlined above.

Virtual-Pixel Screen

The virtual-pixel screen is a system construct serving a very useful purpose, notwithstanding the fact that it does not physically exist in so far as there is an x,y coordinate system map. The relationship between the virtual-pixel screen and the physical-pixel screen in the preferred embodiment is illustrated in FIG. 8. The stroke decoder 102 plots the end-points of a stroke-trajectory on the virtual-pixel screen 500 with the virtual-pixel coordinate system. The stroke-trajectory is finally displayed on the physical pixel screen by the stroke-trajectory generator 103 with the actual pixels addressed in the physical-pixel coordinate system. In the preferred embodiment, the physical-pixel screen or display screen has a horizontal resolution of 256 physical pixels and a vertical resolution of 200 physical pixels. The virtual-pixel screen has a horizontal resolution of 16384 virtual pixels and a vertical resolution of 12800 virtual pixels. Therefore, the resolution of the virtual-pixel screen is 64 times higher than that of the physical-pixel screen.

The reason for the virtual-pixel screen has to do with the fact that the character-field-size dependent stroke attributes can take on fractional values. Since both the physical-pixel coordinate system and the virtual-pixel coordinate system would truncate a fractional value into a discrete value, when the end-points of a stroke are plotted based on either system, truncation errors would result. The truncation error of plotting a stroke-trajectory is equal to the sum or the accumulation of the truncation errors of plotting the composing strokes. However, since the virtual-pixel screen has in general a much better resolution than that of the physical-pixel screen, each truncation error is negligible, and the accumulated truncation errors is minimal.

Character Transformations

Character transformations usually include the functions of character scaling, reflection, and rotation. A desired transformation of a stroke is performed by the character generator shown in FIG. 2 by applying a set of appropriate transformation adjustments to the involved stroke attributes. Except for the "stroke visibility status," all the character-shape dependent and character-field-size dependent stroke attributes are transformation adjustable.

The size scaling transformation of a character image and the corresponding size scaling transformation of a stroke is performed by scaling the size of the global attributes DX-LENGTH and DY-LENGTH which are directly proportional to the character field dimensions (and inversely proportional to the stroke resolution factor). Since a character image is defined within a character field, the horizontal and vertical character image scaling factors are described respectively by the horizontal and the vertical dimension ratios between two sets of character field dimensions. For a given set of horizontal and vertical stroke resolutions of the character field, the global stroke attributes are directly proportional to the character field dimensions. Therefore, size scaling transformation of a stroke is effected by employing the equivalent character image scaling factors in scaling the global stroke attributes. Referring to the Table 5 below, the table illustrates the relationship between the scaling of the character field dimensions and the scaling of the global stroke attributes for a stroke resolution factor of 1.

TABLE 5

| Character Field Dimensions | | Stroke Length Scaling(in pixels) | | Stroke Width Scaling(in pixels) | |
|---|---|---|---|---|---|
| Horz. Field | Vert. Field | DX-LENGTH | DY-LENGTH | PELX-LENGTH | PELY-LENGTH |
| 6 | 10 | 1 | 1 | 1 | 1 |
| 9 | 15 | 1.5 | 1.5 | 1.5 | 1.5 |
| 18 | 20 | 3 | 2 | 3 | 2 |

TABLE 5-continued

| Character Field Dimensions | | Stroke Length Scaling(in pixels) | | Stroke Width Scaling(in pixels) | |
|---|---|---|---|---|---|
| Horz. Field | Vert. Field | DX-LENGTH | DY-LENGTH | PELX-LENGTH | PELY-LENGTH |
| 3 | 8 | 0.5 | 0.8 | 0.5 | 0.8 |

Horizontal Scaling Factor = Ratio between Two Character Field Horizontal Dimensions
Vertical Scaling Factor = Ratio between Two Character Field Vertical Dimensions
DX-LENGTH = Character Horizontal Field Dimension/Horizontal Stroke Resolution
DY-LENGTH = Character Vertical Field Dimension/Vertical Stroke Resolution The scaled DX-LENGTH and DY-LENGTH are calculated by the transformation controller 101 using the relationships shown in Table 5. Table 5 lists just four sample character field dimensions and illustrates how the PELX-LENGTH, DX-LENGTH and DY-LENGTH attributes are affected for a particular stroke resolution factor (i.e., 6 strokes by 10 strokes). For a different stroke resolution factor the global attributes change accordingly. For example Table 6 below lists the same character field dimensions and illustrates the pixel length of the same global attributes for a stroke resolution factor of 2.

TABLE 6

| Character Field Dimensions | | Stroke Length Scaling(in pixels) | | Stroke Width Scaling(in pixels) | |
|---|---|---|---|---|---|
| Horz. Field | Vert. Field | DX-LENGTH | DY-LENGTH | PELX-LENGTH | PELY-LENGTH |
| 6 | 10 | 0.5 | 0.5 | 0.5 | 0.5 |
| 9 | 15 | 0.75 | 0.75 | 0.75 | 0.75 |
| 18 | 20 | 1.5 | 1 | 1.5 | 1 |
| 3 | 8 | 0.25 | 0.4 | 0.25 | 0.4 |

Rotational Transformation

The rotation transformation of a character image about the character field origin is performed in the preferred embodiment by switching the signs and lengths of the DX and DY component vectors and of the logical-pels x and y displacements. In general, to rotate a point (x,y) in the character image through a counterclockwise angle A about the character field origin, the form of the rotation transformation is: $x'=x\cos(A)-y\sin(A)$ and $y'=-x\sin(A)$. If the counterclockwise angle A is restricted to be 0°, 90°, 180° or 270°, the form of the rotation transformation is greatly simplified. Referring to FIG. 18, the diagram illustrates, for a given rotation angle, the required transformation adjustments to the lengths and signs of the component vectors. Referring to FIG. 13, the diagram illustrates, for a given rotation angle, the required transformation adjustments of the lengths and signs of the logical-pel's displacements from the stroke locus. With respect to the stroke attributes of a nonrotated stroke (0° rotation angle), the rotational transformation of a stroke is as follows: (1) switch the lengths of the horizontal and vertical component vectors when the rotation angle is either 90° or 270°; (2) switch the sign of the horizontal component vector when the rotation angle is either 90° or 180°; (3) switch the sign of the vertical component vector when the rotation angle is either 180° or 270°; (4) switch the lengths of the logical-pel's horizontal and vertical displacements from the stroke locus when the rotation angle is either 90° or 270°; (5) switch the sign of the logical-pel's horizontal displacement from the stroke locus when the rotation angle is either 90° or 180° ; and (6) switch the sign of the logical-pel's vertical displacement from the stroke locus when the rotation angle is either 180° or 270°.

Reflection Transformation

Figure 19:
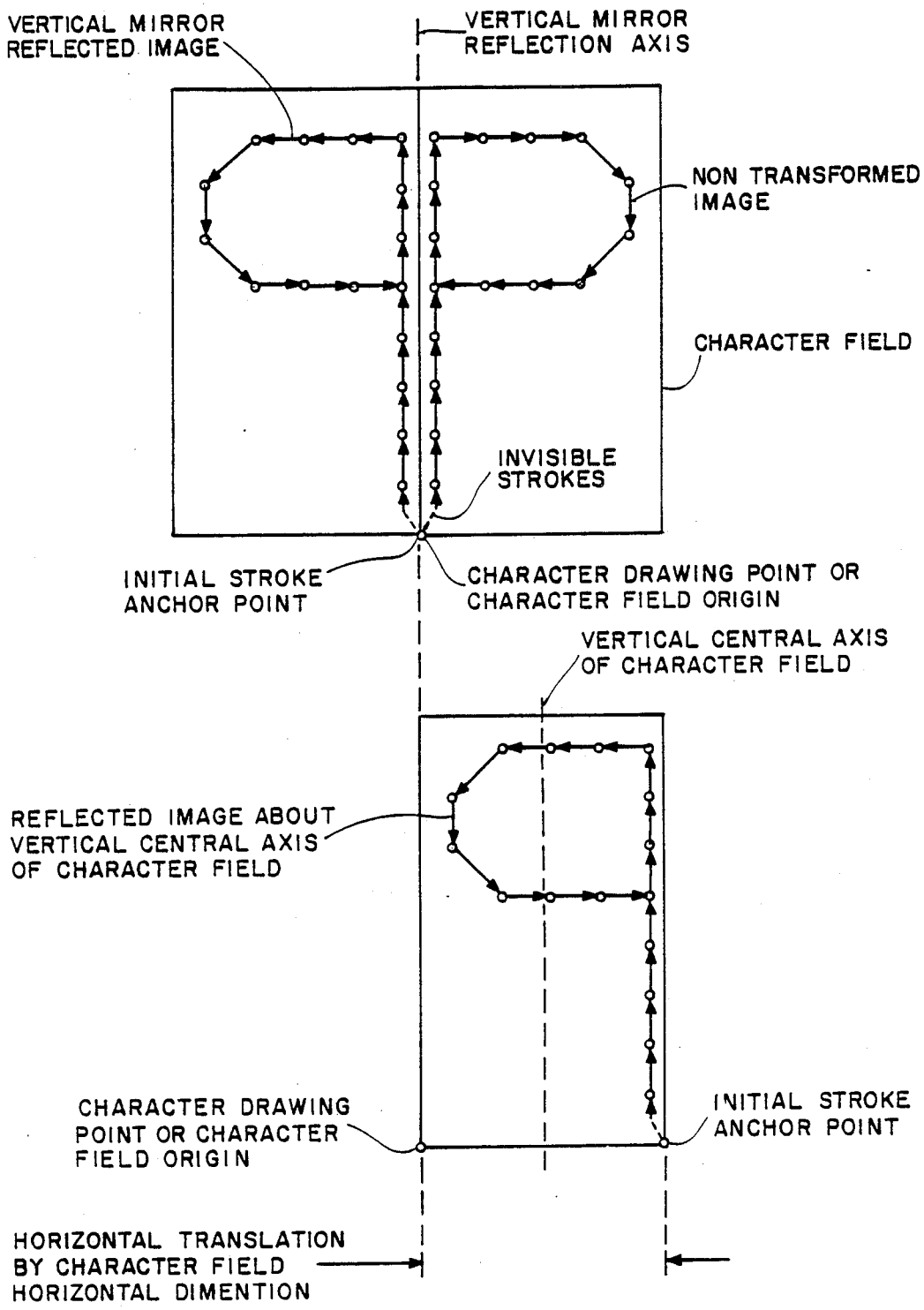
FIG. 19 and FIG. 20 are two diagrams which illustrate that the reflection transformations of a character image can be performed by applying a sequence of two simpler transformations: a scaling followed by a translation.
Figure 20:
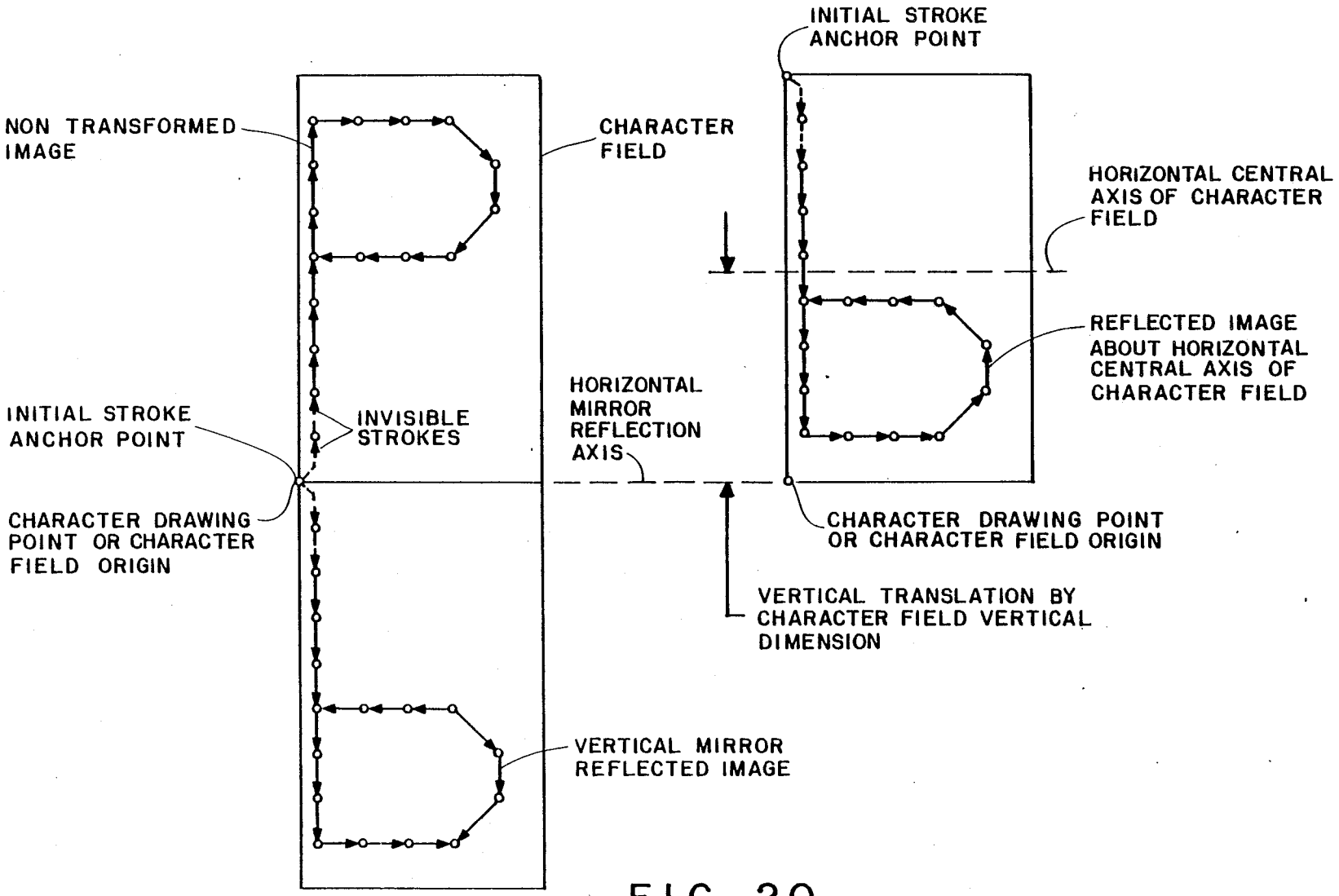

The reflection transformations to a character image about the vertical and horizontal central axes of the character field can be performed by applying a sequence of two simple transformations: a scaling followed by a translation. A mirror image of a character is first generated by applying a scaling transformation. Recall that the forms of the scaling transformation are: $x'=x * Sx$ and $y'=y * Sy$; where (x,y) and (x',y') are the respective old and new points. Sx and Sy are the horizontal and vertical scaling factors. Referring to FIG. 19, by choosing $Sx=-1$ and $Sy=1$, a vertical mirror image is generated. Referring to FIG. 20, by choosing $Sx=1$ and $Sy=-1$, a horizontal mirror image is generated.

By applying translation transformation to the vertical and horizontal mirror images, the desired reflected images about the vertical and horizontal axes of the character field can be obtained. Recall that the forms of the translation transformation are: $x'=x+Tx$ and $y'=y+Ty$; where Tx and Ty are the horizontal and vertical translation displacements. Referring to FIG. 19, by choosing Tx=character field horizontal dimension, the desired reflected image about the vertical axis of the character field is obtained. Referring to FIG. 20, by choosing Ty=character field vertical dimension, the desired reflected image about the horizontal axis of the character field is obtained.

The reflection transformation of a stroke about the vertical central axis of the character field (i.e. with respect to the stroke attributes of a non-reflected stroke), is performed by: (1) switching the sign of the horizontal component vector; and (2) translating the initial stroke anchor point horizontally by a distance equal to the character field horizontal dimension. This is shown in FIG. 19.

The reflection transformation of a character about the horizontal central axis of the character field is best seen in FIG. 20. With respect to the stroke attributes of a non-reflected stroke, the formulation of this particular transformation is: (1) switch the sign of the vertical component vector (DY-SIGN); and (2) translate the initial stroke anchor point vertically by a distance equal to the character field vertical dimension.

For a given character image, the corresponding rotational and reflectional transformation of each stroke of a character image is implemented involuntary and transparently by the stroke decoder 102. The stroke decoder reconstructs the series of strokes of a character image by retrieving the character shape dependent stroke attributive values through the interpretation of the relative stroke-drawing directives encoded in the microprogram. And by applying the set of constant global attributive values which are applicable to each stroke if required.

Example of the Decoding Process

Figure 16:
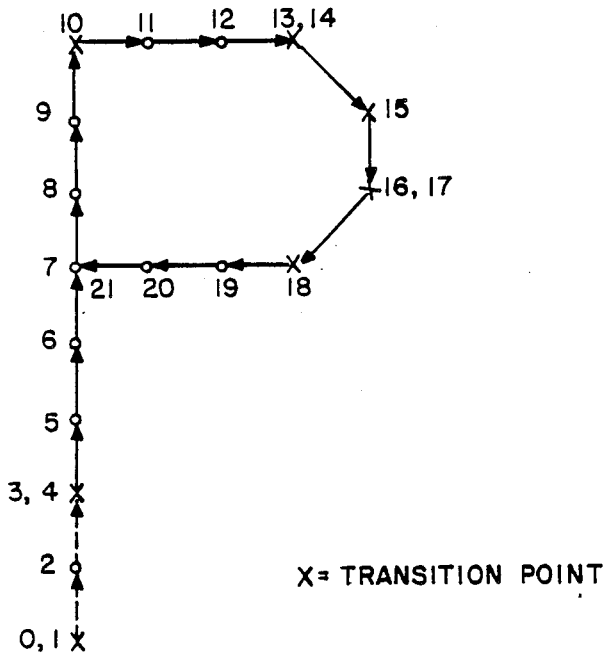
FIG. 16 is a diagrammatic view of a display of the alpha character "P" with no reflection or rotation.

While the functional operation of character generator 100 has been explained with reference to FIG. 2, it is also helpful to follow a step-by-step example showing the decoding process for a complete character. The first example will show in detail the steps performed by the stroke decoder 102 in reconstructing and displaying the letter "P" in an unrotated and unreflected configuration. FIG. 25 illustrates the binary microprogram containing the relative stroke drawing directives for the letter "P". The table in FIG. 14 lists each encoded directive and the decoding of the drawing directives for the letter "P" in an unrotated and unreflected configuration. (As shown in FIG. 23 the DX-SIGN-QUALIFIER is 00 01 and the DY-SIGN-QUALIFIER 00 10 since there is no rotation.) FIG. 16 illustrates the composite stroke vector drawing of the letter "P" as it would be plotted on a display screen.

Before proceeding to decode the drawing directives, it is helpful to recall the steps that are applied in decoding each directive and then in drawing each stroke-trajectory. As explained in connection with the flow diagram of FIG. 6, the first step (1) is to decode the current nibble by using the decoding instructions in Table 3 above. (2) Then carry out the specific instruction by switching the operative parameter specified by the decoded drawing directive. (3) Determine if a trajectory transition has occurred when the drawing directive was carried out. (4) If there is no trajectory transition, update the tail point of the present stroke-vector to the new position $(x_2,y_2)$. (5) If a trajectory transition has occurred, draw the stroke-trajectory to the new tail point, update the starting point $(x_1,y_1)$ to the tail point $(x_2,y_2)$, and determine if a new stroke has been defined (i.e. test if the CURRENT NIBBLE is 01, 10, or 0000.) If a new stroke has been defined, update the tail point to the new $(x_2,y_2)$ position.

Referring to FIG. 14, the bit pattern shown in column 2 is identical to the drawing directives encoded in the microprogram shown in FIG. 25. The first byte of the microprogram contains the number of nibbles necessary to decode the character and this number is first loaded into the nibble counter in the stroke decoder. Then the very next nibble contains the stroke resolution factor which is stored for use in scaling the global attributes. Referring again to FIG. 14, the code step "0" line shows the initial values for each of the five nonglobal attributes. And, in FIG. 16, a "1" is shown next to the initial anchor point as an aid in following what occurs at each code step. A small "x" is also shown to signify a transition point. Neither the "1," the "x," arrowheads shown in FIG. 16 would actually appear on a physical screen.

At code step 1, the first code directive (00 11) is loaded into stroke decoder 102 which interpretes the codes according to the encoding scheme provided in Table 3 above. This table indicates that the (00 11) code means switch the attributive value of the VISIBILITY-STATUS. On line 1 the VISIBILITY-STATUS is switched to "invisibile". This point defines a transition point since a change in one of the drawing directives has occurred. Normally a stroke-vector would be drawn, however, since the stroke starting point $(x_1,y_1)$ and the stroke tail point $(x_2,y_2)$ are the same no stroke is actually drawn.

At code step 2, the second code directive (01) is interpreted. Referring to Table 3 to interpret the code directive, the single nibble (01) means switch the attributive value of DX-EXIST-STATUS. The value of DX-EXIST-STATUS at step 1 is true, so at step 2 it is switched to false. This directive defines another transition at point "0,1" since a change in one of the drawing directives has occurred. Normally a stroke-vector would be drawn, however, since the stroke starting point $(x_1,y_1)$ and the stroke tail point $(x_2,y_2)$ are the same no stroke is actually drawn. Also a first stroke is now defined along with the new updated "tail point" at point "2" (i.e. the end point of a stroke-vector). There is no x-component to the first stroke-vector since the value of DX-EXIST-STATUS is false (does not exist, zero value). The y-component is in the + direction (upward) since DY-SIGN is +. The tail point at point "2" defines the end of a stroke-vector of unit length. When the strokes are actually projected on a display screen the unit length would be factored by the value of the DX-LENGTH or the DY-LENGTH. The "2" in FIG. 16 designates the end of the first stroke-vector (albeit invisible).

At code step 3, the third coded directive (11) is interpreted. Referring to Table 3, the (11) code means no change in the value of either DX-EXIST-STATUS or DY-EXIST-STATUS. There is no change and no stroke transition at this code step. However, since DY-EXIST-STATUS is still true a new tail point $(x_2,y_2)$ is defined which is shown in FIG. 16 as point "3".

At code step 4, the fourth coded directive (00 11) is interpreted. Referring to Table 3, the (00 11) code means switch the VISIBILITY-STATUS. Since (00 11) is a change in a drawing directive, there is a stroke transition at point "3", the stroke is drawn (as an invisible stroke) from the starting point ("0,1" in FIG. 16) to the transition point (3 in FIG. 6), and the starting point $(x_1,y_1)$ is updated to the stroke transition point $(x_2,y_2)$ i.e. tail point at point "3,4".

At code step 5, the fifth coded directive (11) is interpreted. Again referring to Table 3, the (11) code means no change in the attributive values of DX-EXIST-STATUS and DY-EXIST-STATUS. Since there is no stroke transition, the third stroke-vector is not drawn, however, the tail point of that stroke is updated to a new $(x_2,y_2)$, which is point "5" as shown in FIG. 16.

At code step 6, the sixth coded directive (11) is interpreted. Again referring to Table 3, the (11) code means no change in the attributive values of DX-EXIST-STATUS and DY-EXIST-STATUS. Since there is no stroke transition, the fourth stroke-vector is not drawn, however, the tail point of that stroke is updated to a new $(x_2,y_2)$, which is point "6" as shown in FIG. 16.

At code step 7, the seventh coded directive (11) is interpreted. Again referring to Table 3, the (11) code means no change in the attributive values of DX-EXIST-STATUS and DY-EXIST-STATUS. Since there is no stroke transition, the fifth stroke-vector is not drawn, however, the tail point of that stroke is updated to a new $(x_2,y_2)$, which is point "7" as shown in FIG. 16.

At code step 8, the eighth coded directive (11) is interpreted. Again referring to Table 3, the (11) code means no change in the attributive values of DX-EXIST-STATUS and DY-EXIST-STATUS. Since there is no stroke transition, the sixth stroke-vector is not drawn, however, the tail point of that stroke is updated to a new $(x_2,y_2)$, which is point "8" as shown in FIG. 16.

At code step 9, the nineth coded directive (11) is interpreted. Again referring to Table 3, the (11) code means no change in the attributive values of DX-EXIST-STATUS and DY-EXIST-STATUS. Since there is no stroke transition, the seventh stroke-vector is not drawn, however, the tail point of that stroke is updated to a new $(x_2,y_2)$, which is point "9" as shown in FIG. 16.

At code step 10, the tenth coded directive (11) is interpreted. Again referring to Table 3, the (11) code means no change in the attributive values of DX-EXIST-STATUS and DY-EXIST-STATUS. Since there is no stroke transition, the eighth stroke-vector is not drawn, however, the tail point of that stroke is updated to a new $(x_2,y_2)$, which is point "10" as shown in FIG. 16.

At code step 11, a stroke transition occurs at point "10" since the eleventh code directive (00 00) means switch the attributive values of both DX-EXIST-STATUS and DY-EXIST-STATUS. The attributive values of DX-EXIST-STATUS and DY-EXIST-STATUS are reversed so that DX-EXIST-STATUS is true and DY-EXIST-STATUS is false. When a stroke transition occurs, the stroke trajectory is drawn between the present starting point and the tail point. Therefore, a stroke starting at "4" (in FIG. 16) is drawn to the tail point "10", and a new stroke starting point $(x_1,y_1)$ is updated to the tail point $(x_2,y_2)$ at point "10". Lastly since a new stroke has been defined by the (00 00) code, a new tail point is created (at point 11 in FIG. 16).

At code step 12, the twelfth coded directive (11) is interpreted. Again referring to Table 3, the (11) code means no change in the attributive values of DX-EXIST-STATUS and DY-EXIST-STATUS. Since there is no stroke transition, the stroke-vector starting at "10" in FIG. 16 is not drawn, however, the tail point of that stroke is updated to a new $(x_2,y_2)$, which is point "12" as shown in FIG. 16. The stroke-vector is a horizontal vector since the DX-EXIST-STATUS is true and the DX-SIGN is +.

At code step 13, the next coded directive (11) is interpreted. Again referring to Table 3, the (11) code means no change in the attributive values of DX-EXIST-STATUS and DY-EXIST-STATUS. Since there is no stroke transition, the stroke-vector starting at "10" in FIG. 16 is not drawn, however, the tail point of that stroke is updated to a new $(x_2,y_2)$, which is point "13" as shown in FIG. 16. The stroke-vector is another horizontal vector since the DX-EXIST-STATUS is still true and the DX-SIGN is still +.

At code step 14, the next code directive (00 10) is interpreted. Again referring to Table 3, the (00 10) code means change the attributive value of DY-SIGN. At code step 13 DY-SIGN was + so it is changed to −. Since (00 10) is a change in a drawing directive, there is a stroke transition, the stroke is drawn (as three visible strokes) from the starting point (10 in FIG. 16) to the transition point (13 in FIG. 16), and the starting point $(x_1,y_1)$ is updated to the stroke transition point $(x_2,y_2)$ at point "13,14". As before the small "o" signifies a transition point.

At code step 15, the next code directive (10) is interpreted. Again referring to Table 3, the (10) code means change the attributive value of DY-EXIST-STATUS. Therefore DY-EXIST-STATUS changes from false to true meaning that the y-component of the stroke-vector is given a value. Since code directive (10) is a change in a drawing directive, there is a stroke transition at point "13,14", and the stroke must be drawn. However since the starting point (13 in FIG. 16) and the transition point (14 in FIG. 16) are the same points, the stroke-vector reduces to a point. Lastly since the (10) nibble has defined a new stroke, the tail point is updated to the new $(x_2,y_2)$ position which is indicated by the arrowhead at 15 in FIG. 16.

At code step 16, the next code directive (01) is interpreted. Referring to Table 3, the (01) code means switch the value of DX-EXIST-STATUS. At code step 15 the value of DX-EXIST-STATUS is true, and therefore, at code step 16 it is switched to false. This directive defines a transition at point "15" since a change in a drawing directive has occurred. Since there is a stroke transition, the stroke is drawn from the starting point (14 in FIG. 16) to the transition point (15 in FIG. 16). (Both x and y components are true, x is + and y is −, so the stroke-vector is a diagonal vector below the horizontal and pointing in the fourth quadrant.) Next the starting point $(x_1,y_1)$ is updated to the stroke transition point $(x_2,y_2)$ at 15 in FIG. 16. Lastly the tail point of the new stroke is updated as shown by the arrowhead at 16.

At code step 17, the next code directive (00 01) is interpreted. Again referring to Table 3, the (00 01) code means change the attributive value of DX-SIGN. At code step 16 DX-SIGN was + so it is changed to −. Since (00 01) is a change in a drawing directive, there is a stroke transition at point "16", the stroke is drawn (as a visible stroke) from the starting point (15 in FIG. 16) to the transition point (16 in FIG. 16), and the starting point $(x_1,y_1)$ at 15 is updated to the stroke transition point $(x_2,y_2)$ at 16. As before the small "o" signifies a transition point. Lastly since a new stroke has not been defined (i.e. the CURRENT NIBBLE is not equal to 01, 10, or 0000) the tail point is not updated.

At code step 18, the next code directive (01) is interpreted. Referring to Table 3, the (01) code means switch the value of DX-EXIST-STATUS. Since the value of DX-EXIST-STATUS was false it is switched to true. This directive defines a transition at point "17" since a change in a drawing directive has occurred. Since there is a stroke transition, the stroke is drawn from the starting point (17 in FIG. 16) to the transition point (17 in FIG. 16) so no stroke is actually drawn. The stroke tail point is changed to point 18 in FIG. 16 (x has + value and y has a − value).

At code step 19, the next coded directive (10) is interpreted. Again referring to Table 3, the (10) code means change the attributive value of DY-EXIST-STATUS. Since the value of DY-EXIST-STATUS was true it is switched to false. Since (10) is a change in a drawing directive, there is a stroke transition at point "18", the stroke is drawn (as a visible stroke) from the starting point (17 in FIG. 16) to the transition point (18 in FIG. 16), and the starting point $(x_1,y_1)$ is updated to the stroke transition point $(x_2,y_2)$ at point "18". The stroke tail point is updated to point 19 in FIG. 16 (x has a − value and y has no value).

At code step 20, the next code directive (11) is interpreted. Again referring to Table 3, the (11) code means no change in the attributive values of DX-EXIST-STATUS and DY-EXIST-STATUS. Since there is no stroke transition, the stroke-vector is not drawn, however, the tail point of that stroke is updated to a new $(x_2,y_2)$, which is point "20" as shown in FIG. 16, and the starting point $(x_1,y_1)$ remains at point "18" as shown in FIG. 16.

At code step 21, the last code directive (11) is interpreted. Again referring to Table 3, the (11) code means no change in the attributive values of DX-EXIST-STATUS and DY-EXIST-STATUS. The tail point of the last stroke is updated to the new $(x_2,y_2)$, which is point "21" as shown in FIG. 16. Although there is no stroke transition, the stroke-vector is drawn because when the last coded directive is detected, the stroke-vector is drawn. When the nibble counter is decremented to zero, the final stroke is drawn from the current starting point to the tail point. Therefore the stroke-vector is drawn from point 18 in FIG. 16 to point 21 in FIG. 16.

Second Example of the Decoding Process

Figure 17:
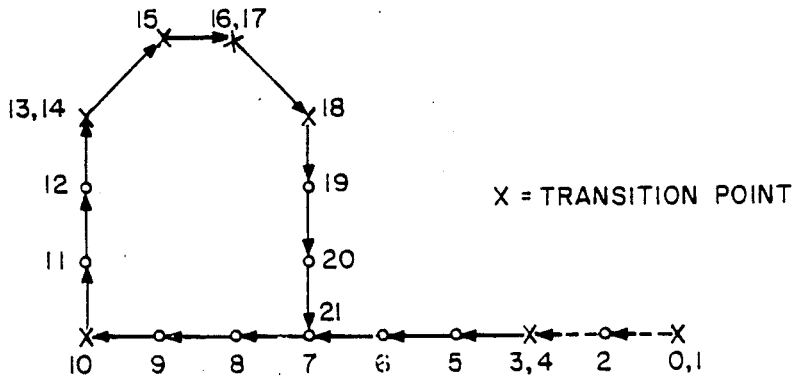
FIG. 17 is a diagrammatic view of a display of the alpha character "P" rotated 90°.

The first example showed in detail the steps performed by the stroke decoder 102 in reconstructing and displaying the letter "P" in an unrotated and unreflected configuration. This second example will illustrate the same process for the letter "P" rotated by 90°. As before the binary microprogram containing the relative stroke drawing directives for the letter "P" (shown in FIG. 25) will be used by the stroke decoder 102. The table in FIG. 15 lists each encoded directive and the decoding of the drawing directives for the letter "P" with a 90° rotation and in an unreflected configuration. As shown in FIG. 23 for a 90° rotation the DX-SIGN-QUALIFIER is 00 10 and the DY-SIGN-QUALIFIER is 00 01. It is now necessary to refer to Table 24*b* to determine how to interpret the two drawing directives (00 01) and (0010). Table 24 shows that these two directives are given the opposite connotation from an unrotated character, i.e. (00 01) means switch the value of DY-SIGN and (00 10) means switch the value of DX-SIGN. FIG. 17 illustrates the composite stroke vector drawing of the letter "P" as it would be plotted on a display screen.

Referring to FIG. 15, the bit pattern shown in column 2 is identical to the drawing directives encoded in the microprogram shown in FIG. 25. At code step "0" the initial values for each of the five nonglobal attributes are loaded into the stroke decoder 102. The 10 attributes for an unreflected character are found in FIG. 21*a* the second column for a character rotation of 90°. (The VISIBILITY-STATUS is always defaulted to be VISIBILE.) Physically these values are stored in memory as part of the stroke decoder 102.

At code step 1, the first code directive (00 11) is loaded into stroke decoder 102 which interpretes the codes according to the encoding scheme provided in Table 3 above and the table in FIG. 24*b*. Table 3 indicates that the (00 11) code means switch the attributive value of the VISIBILITY-STATUS. On line 1 the VISIBILITY-STATUS is switched to "invisible". This point defines a transition point since a change in one of the drawing directives has occurred. Normally a stroke-vector would be drawn, however, since the stroke starting point $(x_1,y_1)$ and the stroke tail point $(x_2,y_2)$ are the same no stroke is actually drawn. Referring to FIG. 17, a "1" is placed next to the small "x" which signifies a transition point.

At code step 2, the second code directive (01) is interpreted. Referring to Table 3 to interpret the code directive, the single nibble (01) means switch the attributive value of DX-EXIST-STATUS. The value of DX-EXIST-STATUS at step 1 is false, so at step 2 it is switched to true. This directive defines another transition at point "0,1" since a change in one of the drawing directives has occurred. Normally a stroke-vector would be drawn, however, since the stroke starting point $(x_1,y_1)$ and the stroke tail point $(x_2,y_2)$ are the same no stroke is actually drawn. Referring to FIG. 17, a "1" is placed next to the small "x" which signifies a transition point. Also a first stroke is now defined along with the new updated first "tail point" at point "2" (i.e. the end point of a stroke-vector). There is no y-component to the first stroke-vector since the value of DY-EXIST-STATUS is false (does not exist, zero value).

The x-component is in the negative x direction since DX-SIGN is minus. The tail point here at point "2" defines the end of a stroke-vector of unit length. When the strokes are actually projected on a display screen the unit length would be factored by the value of the DX-LENGTH or the DY-LENGTH. The "2" in FIG. 17 designates the end of the first stroke-vector (albeit invisible).

At code step 3, the third code directive (11) is interpreted. Referring to Table 3, the (11) code means no change in the value of either DX-EXIST-STATUS or DY-EXIST-STATUS. There is no change and no stroke transition at this code step. However, since DX-EXIST-STATUS is still true a new tail point $(x_2,y_2)$ is defined which is shown in FIG. 17 as 3.

At code step 4, the fourth code directive (00 11) is interpreted. Referring to Table 3 the (00 11) code means switch the VISIBILITY-STATUS. Since (00 11) is a change in a drawing directive, there is a stroke transition at point "3", the stroke is drawn (as an invisible stroke) from the starting point (point "0,1" in FIG. 17) to the transition point (3 in FIG. 17), and the starting point $(x_1,y_1)$ is updated to the stroke transition point $(x_2,y_2)$ i.e. tail point at point "3,4".

At code step 5, the fifth code directive (11) is interpreted. Again referring to Table 3, the (11) code means no change in the attributive values of DX-EXIST-STATUS and DY-EXIST-STATUS. Since there is no stroke transition, the third stroke-vector is not drawn, however, the tail point of that stroke is updated to a new $(x_2,y_2)$, which is point "5" as shown in FIG. 17.

At code step 6, the sixth code directive (11) is interpreted. Again referring to Table 3, the (11) code means no change in the attributive values of DX-EXIST-STATUS and DY-EXIST-STATUS. Since there is no stroke transition, the fourth stroke-vector is not drawn, however, the tail point of that stroke is updated to a new $(x_2,y_2)$, which is point "6" as shown in FIG. 17.

At code step 7, the seventh code directive (11) is interpreted. Again referring to Table 3, the (11) code means no change in the attributive values of DX-EXIST-STATUS and DY-EXIST-STATUS. Since there is no stroke transition, the fifth stroke-vector is not drawn, however, the tail point of that stroke is updated to a new $(x_2,y_2)$, which is point "7" as shown in FIG. 17.

At code step 8, the eighth code directive (11) is interpreted. Again referring to Table 3, the (11) code means no change in the attributive values of DX-EXIST-STATUS and DY-EXIST-STATUS. Since there is no stroke transition, the sixth stroke-vector is not drawn, however, the tail point of that stroke is updated to a new $(x_2,y_2)$, which is point "8" as shown in FIG. 17.

At code step 9, the nineth code directive (11) is interpreted. Again referring to Table 3, the (11) code means no change in the attributive values of DX-EXIST-STATUS and DY-EXIST-STATUS. Since there is no stroke transition, the seventh stroke-vector is not drawn, however, the tail point of that stroke is updated to a new $(x_2,y_2)$, which is point "9" as shown in FIG. 17.

At code step 10, the tenth code directive (11) is interpreted. Again referring to Table 3, the (11) code means no change in the attributive values of DX-EXIST-STATUS and DY-EXIST-STATUS. Since there is no stroke transition, the eighth stroke-vector is not drawn, however, the tail point of that stroke is updated to a new $(x_2,y_2)$, which is point "10" as shown in FIG. 17.

At code step 11, a stroke transition occurs since the eleventh code directive (00 00) means switch the attributive values of both DX-EXIST-STATUS and DY-EXIST-STATUS. The attributive values of DX-EXIST-STATUS and DY-EXIST-STATUS are reversed so that DX-EXIST-STATUS is false and DY-EXIST-STATUS is true. When a stroke transition occurs, the stroke trajectory is drawn between the present starting point and the tail point. Therefore, a stroke starting at "4" (in FIG. 17) is drawn to the tail point "10", and a new stroke starting point $(x_1,y_1)$ is updated to the tail point $(x_2, y_2)$ at point "10". Lastly since a new stroke has been defined by the (00 00) code, a new tail point is created (at point 11 in FIG. 17).

At code step 12, the twelfth coded directive (11) is interpreted. Again referring to Table 3, the (11) code means no change in the attributive values of DX-EXIST-STATUS and DY-EXIST-STATUS. Since there is no stroke transition, the stroke-vector starting at "10" in FIG. 17 is not drawn, however, the tail point of that stroke is updated to a new $(x_2,y_2)$, which is point "12" as shown in FIG. 17. The stroke-vector is a vertical vector since the DX-EXIST-STATUS is false, DY-EXIST-STATUS is true and the DY-SIGN is +.

At code step 13, the next coded directive (11) is interpreted. Again referring to Table 3, the (11) code means no change in the attributive values of DX-EXIST-STATUS and DY-EXIST-STATUS. Since there is no stroke transition, the stroke-vector starting at "10" in FIG. 17 is not drawn, however, the tail point of that stroke is updated to a new $(x_2,y_2)$, which is point "13" as shown in FIG. 17. The stroke-vector is another vertical vector since the DX-EXIST-STATUS is still false, the DY-EXIST-STATUS is still true, and the DY-SIGN is still +.

At code step 14, the next code directive (00 10) is interpreted. Referring to the table in FIG. **24*b*, the (00 10) code means change the attributive value of DX-SIGN. At code step 13 DX-SIGN was − so it is changed to +. Since (00 10) is a change in a drawing directive, there is a stroke transition, the stroke is drawn (as three visible strokes) from the starting point (10 in FIG. 17) to the transition point (13 in FIG. 17**), and the starting point $(x_1,y_1)$ is updated to the stroke transition point $(x_2,y_2)$ at point "13,14". As before the small "o" signifies a transition point.

At code step 15, the next code directive (10) is interpreted. Again referring to Table 3, the (10) code means change the attributive value of DY-EXIST-STATUS. Therefore DY-EXIST-STATUS changes from true to false meaning that both DX-EXIST-STATUS and DY-EXIST-STATUS are false. Referring to Table 2 above, when both DX-EXIST-STATUS and DY-EXIST-STATUS are false, the resultant stroke-vector is a diagonal stroke. To determine the direction of the diagonal stroke, examine the signs of DX-SIGN and DY-SIGN. Since both signs are + the resultant vector is a diagonal vector pointing in the first quadrant. Since code directive (10) is a change in a drawing directive, there is a stroke transition at point "13,14", and the stroke must be drawn. However since the starting point (13 in FIG. 17) and the transition point (14 in FIG. 17) are the same points, the stroke-vector reduces to a point. Lastly since the (10) nibble has defined a new stroke, the tail point is updated to the new $(x_2,y_2)$ position which is indicated by the arrowhead at 15 in FIG. 17.

At code step 16, the next code directive (01) is interpreted. Referring to Table 3, the (01) code means switch the value of DX-EXIST-STATUS. At code step 15 the value of DX-EXIST-STATUS is false, and therefore, at code step 16 it is switched to true. This directive defines a transition at point "15" since a change in a drawing directive has occurred. Since there is a stroke transition, the stroke is drawn, from the starting point (14 in FIG. 17) to the transition point (15 in FIG. 17). Since the DX-EXIST-STATUS is true and DY-EXIST-STATUS is false, the resultant stroke-vector is a vector horizontal line pointing in the + direction. Next the starting point ($x_1$,$y_1$) is updated to the stroke transition point ($x_2$, $y_2$) at 15 in FIG. 17. Lastly the tail point of the new stroke is updated as shown by the arrowhead at 16.

At code step 17, the next code directive (00 01) is interpreted. Again referring to the table in FIG. 24*b*, the (00 01) code means change the attributive value of DY-SIGN. At code step 16 DY-SIGN was + so it is changed to −. Since (00 01) is a change in a drawing directive, there is a stroke transition at point "16", the stroke is drawn (as a visible stroke) from the starting point (15 in FIG. 17) to the transition point (16 in FIG. 17), and the starting point ($x_1$,$y_1$) at 15 is updated to the stroke transition point ($x_2$,$y_2$) at 16. As before the small "o" signifies a transition point. Lastly since a new stroke has not been defined (i.e. the CURRENT NIBBLE is not equal to 01, 10, or 0000) the tail point is not updated.

At code step 18, the next code directive (01) is interpreted. Referring to Table 3, the (01) code means switch the value of DX-EXIST-STATUS. Since the value of DX-EXIST-STATUS was true it is switched to false meaning that again both DX-EXIST-STATUS and DY-EXIST-STATUS are false. Referring to Table 2 above, when both DX-EXIST-STATUS and DY-EXIST-STATUS are false, the resultant stroke-vector is a diagonal stroke. To determine the direction of the diagonal stroke, examine the signs of DX-SIGN and DY-SIGN. Since DX-SIGN is + and DY-SIGN is −, the resultant vector is a diagonal vector pointing in the fourth quadrant. This directive defines a transition at point "17" since a change in a drawing directive has occurred. Since there is a stroke transition, the stroke is drawn from the starting point (17 in FIG. 17) to the transition point (17 in FIG. 17) so no stroke is actually drawn. The stroke tail point is changed to point 18 in FIG. 17.

At code step 19, the next coded directive (10) is interpreted. Again referring to Table 3, the (10) code means change the attributive value of DY-EXIST-STATUS. Since the value of DY-EXIST-STATUS was false it is switched to true. Since (10) is a change in a drawing directive, there is a stroke transition at point "18", the stroke is drawn as a visible stroke from the starting point (18 in FIG. 17) to the transition point (19 in FIG. 17), and the starting point ($x_1$,$y_1$) is updated to the stroke transition point ($x_2$,$y_2$) at point "18". The stroke tail point is updated to point 19 in FIG. 17 (y has a − value and x has no value).

At code step 20, the next code directive (11) is interpreted. Again referring to Table 3, the (11) code means no change in the attributive values of DX-EXIST-STATUS and DY-EXIST-STATUS. Since there is no stroke transition, the stroke-vector is not drawn, however, the tail point of that stroke is updated to a new ($x_2$,$y_2$), which is point "20" as shown in FIG. 17, and the starting point ($x_1$,$y_1$) remains at point "18" as shown in FIG. 17.

At code step 21, the last code directive (11) is interpreted. Again referring to Table 3, the (11) code means no change in the attributive values of DX-EXIST-STATUS and DY-EXIST-STATUS. The tail point of the last stroke is updated to the new ($x_2$,$y_2$), which is point "21" as shown in FIG. 17. Although there is no stroke transition, the stroke-vector is drawn because when the last coded directive is detected, the stroke-vector is drawn. When the nibble counter is decremented to zero, the final stroke is drawn from the current starting point to the tail point. Therefore the stroke-vector is drawn from point 18 in FIG. 17 to point 21 in FIG. 17.

While a preferred embodiment of the present invention is disclosed and described above, it is contemplated that those skilled in the art may make numerous changes thereto without departing from the spirit and scope thereof. For example, it is intended that the present invention be embodied in either a programmable digital computer-type apparatus (such as a microprocessor) or in an apparatus wherein the functions of the invention are performed by fixed circuit elements which may or may not include some programmable features. Obviously, the widest flexibility of the inventions will be obtained with programmable digital computer-type apparatus. For these reasons, it is intended that the present invention not be limited to the embodiment described above, but rather be determined solely by reference to the claims hereinafter provided.

What is claimed is:

1. In an electronic graphic display system capable of displaying characters on a display screen, a method of generating characters by interconnecting a series of stroke-vectors, each stroke-vector being characterized by at least a plurality of character-shape dependent stroke attributes and a plurality of character-field-size dependent stroke attributes, said method comprising the steps of:

receiving a first data signal defining a character type, character field dimensions, and a character drawing point;

retrieving from a first memory a plurality of encoded binary valued stroke-drawing directives for the character type defined by said first data signal;

retrieving from a second memory encoded initial values for each character-shape dependent stroke attribute, said initial values being independent of the character type;

decoding said encoded stroke-drawing directives and said encoded initial values and sequentially applying the decoded drawing directives to the decoded initial values thereby generating a series of stroke signals representing a series of interconnected stroke-vectors;

scaling the length of each stroke-vector so that the resulting character image is scaled to the character field dimensions defined by said first data signal; and converting each scaled stroke-vector into a series of signals to generate start/stop positions, of each interconnected stroke-vector, said series of signals defining a character mask for the character type defined by said first data signal.

2. The method according to claim 1 further including the steps of projecting said scaled stroke-vectors at said character drawing point onto said display screen and thereby generating the desired character display.

3. The method according to claim 2 further including the steps of mapping said scaled stroke-vectors into a virtual-pixel display, and converting the coordinates of said virtual-pixel display to the coordinates of said display screen, both steps performed prior to the step of projecting said scaled stroke-vectors at said character drawing point onto said display screen.

4. The method according to claim 3 wherein the step of scaling the length of each stroke-vector results in a series of stroke-vectors wherein each horizontal stroke-vector is made uniform in length, wherein each vertical stroke-vector is made uniform in length, such that the horizontal stroke-vector span and the vertical stroke-vector span are made equal to their respective character field dimensions specified by said first data signal.

5. The method according to claim 1, wherein the first retrieving step is performed by:

decoding said first data signal and generating a character code signal defining the character type;

addressing a location in said first memory using said character code signal as a memory address; and reading out of said first memory means a plurality of encoded binary valued stroke-drawing directives.

6. The method according to claim 5 further comprising:

applying logical pel attributes to said scaled stroke-vectors prior to the step of projecting.

7. The method according to claim 5 further comprising the followng steps performed after the step of scaling:

generating the signals PELX-LENGTH and PELY-LENGTH corresponding to the X,Y dimensions of a logical pel, and also generating an output signal corresponding to the pixel location on said display screen of said series of stroke signals with the logical-pel superimposed thereon.

8. In an electronic graphic display system having a character generator, a method of generating characters having a plurality of possible character image rotations by interconnecting a series of stroke-vectors, each stroke-vector being characterized by at least a plurality of character-shape dependent stroke attributes and a plurality of character-field-size dependent stroke attributes, said method comprising the steps of:

receiving a first data signal defining a character type, character field dimensions, a character drawing point; and a character rotation;

retrieving from a first memory a plurality of binary valued stroke-drawing directives for the character defined by said first data signal;

retrieving from a second memory encoded initial values for each character-shape dependent stroke attribute, said initial values being only dependent upon said character rotation;

decoding said encoded stroke-drawing directives and sequentially applying the decoded drawing directives to said initial values thereby generating a series of stroke signals representing a series of interconnected stroke-vectors;

scaling the length of each stroke-vector to a character cell size having the character field dimensions defined by said first data signal;

converting each scaled stroke-vector into a series of signals to generate start/stop positions of each interconnected stroke-vector, said series of signals defining a character mask for the character type defined by said first data signal.

9. The method according to claim 8 further including the steps of projecting said scaled stroke-vectors at said character drawing point onto said display screen and thereby generating the desired character display.

10. The method according to claim 9, wherein the first retrieving step is performed by:

decoding said first data signal and generating a character code signal defining the character type;

addressing a location in said first memory using said character code signal as a memory address; and reading out of said first memory means a plurality of encoded binary valued stroke-drawing directives.

11. The method according to claim 10 further comprising:

applying logical pel attributes to said scaled stroke-trajectories prior to the step of projecting.

* * * * *